US011864636B2

(12) United States Patent
Soden et al.

(10) Patent No.: US 11,864,636 B2
(45) Date of Patent: Jan. 9, 2024

(54) JEWELLERY KEEPER

(71) Applicants: Muriel Anne Mary Soden, Belgian Gardens (AU); Wade Andrew Lavery, Wulguru (AU)

(72) Inventors: Muriel Anne Mary Soden, Belgian Gardens (AU); Wade Andrew Lavery, Wulguru (AU)

( * ) Notice: Subject to any disclaimer, the term of this patent is extended or adjusted under 35 U.S.C. 154(b) by 72 days.

(21) Appl. No.: 17/418,582

(22) PCT Filed: Dec. 27, 2019

(86) PCT No.: PCT/AU2019/051438

§ 371 (c)(1),
(2) Date: Jun. 25, 2021

(87) PCT Pub. No.: WO2020/132719

PCT Pub. Date: Jul. 2, 2020

(65) Prior Publication Data

US 2022/0061478 A1 Mar. 3, 2022

(30) Foreign Application Priority Data

Dec. 27, 2018 (AU) ..... 2018904956

(51) Int. Cl.
*A44C 15/00* (2006.01)

(52) U.S. Cl.
CPC ..... *A44C 15/003* (2013.01)

(58) Field of Classification Search
CPC ..... A44C 25/00; A44C 25/001; A44C 13/00; A44C 15/003; A44C 17/0216; A44C 17/0225
USPC ..... 63/18.19, 1.14
See application file for complete search history.

(56) References Cited

U.S. PATENT DOCUMENTS 2,665,042 A 1/1954 Starolis
5,758,516 A * 6/1998 Uematsu ..... A44C 15/003 63/23

(Continued)

FOREIGN PATENT DOCUMENTS

DE 102006001228 A1 * 7/2007 ..... A44C 11/00
GB 2311927 A 10/1997

(Continued)

OTHER PUBLICATIONS

International Search Report in corresponding PCT application No. PCT/AU2019/051438, dated Mar. 3, 2020, 6 pp.

(Continued)

*Primary Examiner* — Jack W Lavinder
(74) *Attorney, Agent, or Firm* — Tredecim LLC; Sean L. Sweeney

(57) ABSTRACT

A jewellery keeper wearable by a person to securely hold jewellery items, the keeper including, a keeper body. A location is included on the keeper body adapted to receive one or more jewellery item thereon and a securing means including a lock device, to secure the jewellery on the keeper body, and lock it securely such that it cannot be released from the keeper body without operation of the lock device. The one or more items of jewellery are positioned on the keeper body and the lock device of the securing means locks the jewellery in place, so the jewellery is securely held on the keeper body and also held in an attractive presentation for wear by the person. The invention also relates to variants thereon and a methods of use.

7 Claims, 25 Drawing Sheets

(56) References Cited

U.S. PATENT DOCUMENTS

| | | | | |
|---|---|---|---|---|
| 7,188,493 | B2 * | 3/2007 | Conway | A44C 25/001 63/3 |
| 2006/0185393 | A1 * | 8/2006 | Cherry | A44C 25/001 63/40 |
| 2015/0027166 | A1 | 1/2015 | Mace | |
| 2016/0007701 | A1 * | 1/2016 | Silverstein | A44C 25/002 63/19 |

FOREIGN PATENT DOCUMENTS

| | | | |
|---|---|---|---|
| JP | 3166350 | U | 3/2011 |
| JP | 2017202067 | A | 11/2017 |
| KR | 20030039941 | A | 5/2003 |

OTHER PUBLICATIONS

Written Opinion in corresponding PCT application No. PCT/AU2019/051438, dated Mar. 3, 2020, 6 pp.
International Preliminary Report on Patentability in corresponding PCT application No. PCT/AU2019/051438, dated Apr. 20, 2021, 61 pp.
Machine translation of JP 2017202067 A produced by Espacenet, 4 pp.
Extended European Search Report in corresponding application No. EP 19905145.9, dated Sep. 2, 2022, 7 pp.
Machine translation of KR 20030039941 A produced by Espacenet, 24 pp.
Machine translation of JP 3166350 U produced by Espacenet, 13 pp.

* cited by examiner

JEWELLERY KEEPER

FIELD OF THE INVENTION

The present invention relates to a jewellery keeper, and in particular to jewellery keeper than enables the jewellery to be worn securely and attractively.

BACKGROUND OF THE INVENTION

Wearing of jewellery has been an important part of life for people for thousands of years. Ornament is a factor, to make ourselves attractive, but jewellery is also an indicator of status and wealth. In modern times we still wear wedding rings, friendship rings and rings to indicate formal relationships and membership of an exclusive group or society. These status rings are important to the person, and tend to be worn every day when out in public to indicate the status to others. However, in many professions such as medical and healthcare, the wearing of rings is prohibited. Many people wear their rings at all times except when sleeping and so are uncomfortable having to remove their rings to work. Clearly, there are excellent reasons to remove rings when working in healthcare as they could harbour dirt or bacteria, may cut sterile gloves, or could interfere with the delicate manual tasks being undertaken. There is also a risk with any item of jewellery in surgery or medical procedures that these may fall into a wound—generally both patients and medical personnel remove their jewellery during any medical procedure.

Removal of the jewellery from the hands is practical and must be undertaken, but for many people they would prefer to keep these important items close to them, and of course secure. Wedding rings sets are often the most valuable pieces of jewellery a person owns, and so not only do they wish they were wearing the rings at all times to indicate status, but also they want the rings close, to keep them safe and secure. Rings and other valuable items if removed may need to be left in a handbag, which is not secure, or if available the items may be put in a locker while the person is working. The locker can provide the security, but this is not the same as having these precious and valuable items with you at all times, there is always the doubt until the rings are back safe on your finger that they may have been stolen or got lost somehow. Wedding rings can be considered irreplaceable as these have all the memories of the wedded life of a couple tied up with the jewellery making them all the more valuable and precious to the wearer.

For these valuable and precious items, it is desirable for a person to keep them close at all times and carry the items with them when they are working. One way is to put the jewellery items in a pocket so the items are not out of the person's control, even when they are working. However, pockets are not secure, and the person will find that they frequently wanting to check to see that the rings or other items are still inside the pocket.

The problem has been around for a very long time, how do you carry your items with you, and keep them safe and secure? Simple wearable devices to carry rings are known, but these simple devices only look to address some of the issues identified as problems. For example, US publication US 2015/0320156 Meisenbach introduces a wearable locket to hide valuable items, using two faces with a space between them to hold something. The invention described focuses very much on hiding an item, rather than securely displaying the items, such as a private token. An item such as a wedding ring, or wedding ring set would not fit within the locket style space and the focus and features of the described invention are quite different. A similar locket style invention was published as US 2015/0089976 Alulis with a closable locket frame to hold an exchangeable disc. The frame clips into place and enables different items to be used but not to secure rings or display these as a pendant. Also known is a gallery pendant subject of U.S. Pat. No. 9,439,485 McGarry, designed again with a frame to put a very small item such as a gem or paper to display it as wearable art. Again, only a single ring, and certainly not multiple rings, could be put inside the frame, it is more like a miniature picture frame to make a wearable art piece, not useful to be worn when working to keep rings and the like secure.

The closest known prior art discloses a wearable single band ring holder subject of U.S. Pat. No. 8,707,731 Crittenden, useful to hold a single simple ring by looping the cord through the ring so that the necklace can be worn and the ring put in place or removed without removing the chain. The chain is looped through the ring, or the pendant part inverted to hold the ring. The looping method, as detailed in the many drawings, seems rather complex and would take some practise to achieve, this is risky as if the ring is not secured properly it may be lost. The arrangement does seem somewhat inconvenient to use and moreover is fully directed to holding a single plain wedding ring, not multiple items. Security of the items is paramount and the subject invention has developed a far improved method of securing one or more rings, which holds the items very securely, in a very easy to use arrangement, forming a sophisticated pendant or nurses fob arrangement. Further the subject invention presents the items in an attractive way to make the most of these valuable and handsome pieces of jewellery so that it forms an enticing jewellery item that a person may wish to show off in its own right. The invention also includes a separator to hold multiple rings apart from one another, and a wear insert to prevent wear of the rings if they were to rub or touch against each other. The strong secure, and attractive article, subject of the present invention is a highly beneficial and sophisticated item when compared to the prior art.

The subject invention is a considerable advance over the prior art and has been developed through long and careful research and development to address this long felt want for a better way to wear and keep rings safe, when not able to wear the rings on the hands. The subject invention has therefore been developed to provide a useful means for the person to wear the jewellery so as to be with them but away from their hands, that is secure, can hold multiple items, is easy to use and can be used to present the items attractively during wear.

It is anticipated that the invention will be very well received by people in the health professions in particular, so a person can keep their rings with them while working. But there are numerous other applications, for example, to keep jewellery safe when doing any manual work, painting, or work around the house or garden. There have been numerous cases of a person losing their precious rings in the garden and them simply never being found again. People do not like to take off their rings or to leave them unsecured in the home while they work. Through use of the invention the rings can be kept safe, clean and not at risk of being lost, and with the person at all times. For teachers and carers, the invention will also be very useful so that the person can remove their rings for work, but wear them about their neck instead, and keep them safe and secure with them throughout the day.

The following describes non-limiting examples of the invention being used with reference to hold a wedding ring set in a nurse's fob arrangement, as a useful example. The invention may be used by any person, privately or in their professional life who wishes to carry their jewellery with them but secure them. It is not intended to limit the user of the invention other than as defined in the claims. Further, the invention is designed to carry rings, and in particular wedding rings, but can be used for any item of jewellery or the like that can be secured. These other items may be any other jewellery item that can be fitted on the jewellery keeper. The invention is well suited to use as a nurse's fob, but can also be used as any fob, pendant or similar arrangement. Use of the invention with a strong chain to be worn around the neck securely is another very useful form of the invention. It is not intended to limit the invention in any way, or to any particular item of jewellery, or fob arrangement, other than as defined in the claims.

For clarity, any prior art referred to herein, does not constitute an admission that the prior art forms part of the common general knowledge, in Australia or elsewhere.

It is an object of the present invention to provide a jewellery keeper that at least ameliorates one or more of the aforementioned problems of the prior art. It is a further and separate object of the present invention to provide a method of keeping jewellery, that at least ameliorates one or more of the aforementioned problems of the prior art.

DISCLOSURE OF THE INVENTION

Accordingly, the present invention provides a jewellery keeper wearable by a person to securely hold jewellery items, the keeper including:

a keeper body;

a location on the keeper body adapted to receive one or more jewellery item thereon;

a securing means including a lock device, to secure the jewellery on the keeper body, and lock it securely such that it cannot be released from the keeper body without operation of the lock device, wherein the one or more items of jewellery are positioned on the keeper body and the lock device of the securing means locks the jewellery in place, so the jewellery is securely held on the keeper body and also held in an attractive presentation for wear by the person.

Accordingly, the invention also provides a jewellery keeper, wearable by a person, for securely holding jewellery items, the jewellery keeper including:

a keeper body including at least two moveable parts which together form a jewellery cage in the closed state, and are able to receive the jewellery items in the open state;

a substantially cylindrical wear means location within the keeper body, adapted to receive one or more jewellery item thereon, looped around the cylindrical wear means, when the jewellery cage is in the open state, and the wear means location including a suitable soft material so that contact by the jewellery items does not damage the jewellery items;

a multi-stage securing means including separating and closing the keeper body jewellery cage parts about the jewellery items on the substantially cylindrical wear means, and a lock device with push release, to secure the jewellery keeper body maintaining the moveable jewellery cage securely locked securely so that the jewellery items cannot be released from the jewellery cage of the keeper body without operation of the push release of the lock device and opening of the jewellery cage parts, wherein the one or more items of jewellery are positioned on the keeper body substantially cylindrical wear means location within the jewellery cage keeper body, and the jewellery cage then closed, and the lock device of the securing means locks the jewellery cage in place, so the jewellery items are securely held on the keeper body until push release of the lock device and opening of the jewellery cage, and the jewellery items are held in an attractive presentation for wear by the person.

The jewellery may be any suitable item of jewellery it is desired to keep secure, when not worn. The jewellery may include a ring. Most preferably, the jewellery is more than one ring, and the jewellery keeper holds the rings secure and presented attractively during use.

The jewellery may be chosen from the group: ring; pendant; earrings; or chain. The jewellery may be any suitable precious item, and may include a key or other small item, in some forms of the invention. The item may be any item including a ring that may be secured through to hold on the keeper. Preferably, the invention is used for carrying a wedding ring. Preferably, the invention is used to hold a wedding ring and other items. Preferably, a wedding ring set may be held by the keeper. Preferably, a wedding ring set and one or more other rings may be held in the keeper. Preferably, three rings may be kept, each held separately.

Preferably, more than one item of jewellery is kept in the keeper. Most preferably, a wedding ring and engagement ring can be held in the keeper. The number of items held may be chosen from the following group: 1; 2; 3; 4; and 5 for example. Any suitable number of items may be held.

The jewellery keeper may be worn in any suitable manner. For example, the jewellery keeper may be in the form of a fob. The jewellery keeper may be a nurse's fob. The jewellery keeper may take the form of a pendent. The jewellery keeper may be worn in more than one manner. Preferably, the invention is adapted to be suspended in any suitable manner. The jewellery keeper may include the means to be worn, such as a chain to wear about the neck or secure fob attachment or clothing. Preferably, the invention includes a chain to secure the jewellery keeper about the neck of a person. A brooch arrangement may be used instead.

Preferably, the jewellery keeper has an attractive overall appearance. Preferably, the jewellery keeper is configured to coordinate or extenuate the appearance of the items to be held. The jewellery keeper is preferably made of a suitable metal material. The jewellery keeper may be made of a combination of suitable metal materials. The jewellery keeper may be finished or include precious metals. The precious metals may include silver, gold, and platinum. Combinations of materials may be used, including alloys.

The overall shape of the jewellery keeper may be designed to appeal to the eye. The overall shape of the jewellery keeper may be fob, pendent or similar shape. The overall shape of the jewellery keeper, when viewed from the front may be chosen from the group: circular; irregular shape; oval; rectangular including square; teardrop; triangular; or a combination of suitable shapes.

The jewellery keeper may include ornamentation or decoration. The ornamentation or decoration may include engraving. One or more gemstones may be included in the jewellery keeper. Preferably, the jewellery keeper is itself an attractive piece of jewellery. Preferably, the jewellery keeper improves the look of the jewellery to be kept therein.

The person may be anyone who wishes to securely hold their items. The person may be a health professional. The person may be a nurse. The person may be a doctor. The person may be a teacher, care-worker or other person who needs to remove their rings during work. The person may be anyone who is carrying out manual work such as in the home or garden and needs to remove their rings but to keep them safe and secure while doing so.

The secure hold may be any suitable secure hold to substantially prevent loss of the items from the jewellery keeper. Preferably, the secure hold maintains the items safely in the jewellery keeper until the items are specifically removed. Preferably, the secure hold is to hold the items within the jewellery keeper and substantially prevent loss by the person. Preferably, the jewellery keeper securely holds and displays the items to keep them safe and secure and with the person until they can return the rings to their fingers. Most preferably, the security includes a plurality of means to keep the jewellery items on the jewellery keeper to substantially prevent accidental loss.

The keeper body may take any suitable form. Preferably, the keeper body is configured to enable a loop or ring to be placed or positioned over the keeper body in an unsecured state and that the loop or ring is secured to the keeper body in the secured state. The keeper body may include one or more arms. The keeper body may include a pair of arms. There may be two pairs of arms in some forms of the invention. Preferably, at least part of the keeper body can be used to thread or otherwise feed on the loop or a ring part of a jewellery item in the unsecured state whereby in the secured state the jewellery item is maintained on the keeper body. Arms of the keeper body may be used to open out to enable rings to be threaded on and then closed up again to be secured with the securing means. Preferably, the keeper body itself forms a secure loop or ring in the secured state that can have jewellery items threaded on in the open state. The keeper body may form a cage or ring cage in some forms of the invention. The use of a ring cage is convenient to show the rings, be lightweight and secure. However, other arrangements including a back or walls instead of arms could be used in other forms of the invention. Most preferably, the keeper body can readily be moved between an open state whereby a loop or ring may be threaded on and a closed state where the items may be secured. The keeper body may be hinged to move between and open and closed state, secured by the securing means.

Most preferably, the invention includes two stages of closure to substantially prevent accidently loss. The two stages of closure may take any suitable form.

Preferably, the keeper body includes one or more specific location for the placing or positioning of the jewellery item. The location may be defined by gravity, being the lowest point of the keeper body where the items will hang. The location may be a location anywhere on the keeper body to hold the items. Preferably the location is adapted to receive more than one item in one form of the invention. For example, two or more rings may be held at one location on the keeper body. In other forms of the invention more than one location may be defined for separately holding items. Preferably, a plurality of locations on the keeper body may be used to hold the jewellery items.

The items may be held in an upright orientation, or the items may be held hanging. Preferably, items may be held in the upright and hanging orientation as a matter of choice of the user. The orientation can change the look or presentation of the jewellery in the jewellery keeper to give options to the user. A solitaire engagement ring may be held to present the stone in an attractive presentation as a piece of jewellery with the keeper in its own right.

Preferably, a holding means is included at the one or more location on the keeper body to maintain the jewellery items in place.

The location may include a separation means to hold and separate more than one items of jewellery. The separation means may take any suitable form. Preferably, the separation means presents the jewellery in an attractive manner. Preferably, the separation means prevents the jewellery items wearing against one another. Preferably, the separation means prevents wear of the jewellery. Preferably, the wear is prevented by the wear means being of a softer material that the jewellery to be kept. The separation means may take any suitable form. The separation means may include a flat surface. The separation means may separate the keeper body from the jewellery items. The separation means may include one projection and each jewellery item is positioned or placed on a projection. The projections may be in the form of more than one hooks onto which items may be placed and held. The hooks may stack the jewellery items to be separated to some extent. Preferably, the separation means holds the items, separated and presented attractively. The stacking or arrangement may be similar to that shown in FIG. 36, for example. More than 3 hooks or separating parts may be used to hold more than 3 items, in some forms of the invention.

Preferably, a wear means is included and the wear means is situated on the keeper body at the location adapted to receive one or more jewellery items. The wear means may be incorporated in or about any part of the jewellery keeper where jewellery may rest to prevent wear to the jewellery. Preferably, the wear means is made of a softer material than the jewellery. Preferably, the wear means is made of a softer metal than the jewellery material. Preferably, the wear means is at the point where the jewellery item will contact or wear on the keeper body. Preferably, the wear means will wear before the jewellery so as to substantially act against wear or scratches on the jewellery due to contact with the keeper body. Preferably, the wear means is made of a soft material. Preferably the wear means is made of a soft metal. The wear means may be made of silver. Preferably, the wear means is made of a material softer than the material of the jewellery whereby the wear means will wear before the jewellery. The wear means therefore is a protection against damage for the jewellery held in the keeper. The wear means may also be made of plastics or other non-metal materials.

The wear means and the separation means may be the same. The holding means may include multiple items, including wear means and or separation means. The wear means may include one projection and each jewellery item is positioned or placed on a projection. The projections may be in the form of more than one hooks onto which items may be placed and held. The hooks may stack the jewellery items to be separated to some extent. Preferably, the wear means holds the items, separated and presented attractively.

The location may be anywhere on the keeper body. Preferably, the location is at the same location as the wear means. The wear means or separation means may be the location. Preferably, the location to receive the jewellery items is the wear means. Preferably, the location to receive the jewellery items is the wear means or separation means, and the wear means substantially holds and prevents wear to the jewellery items while being held.

Preferably, the location to hold the jewellery items is configured to hold in place. Preferably, the location may hold multiple items of jewellery in a secure placement.

Preferably, the holding means presents the jewellery is an attractive arrangement. The holding means may present the stone of an engagement ring somewhat as a pendant. A wedding ring and other rings may be arranged and presented attractively as a pendant.

Preferably, a securing means is included that substantially acts against accidental loss of the jewellery items in use. Preferably, the securing means includes a plurality of securing features to keep the jewellery items on the keeper body, even when only partially closed. The securing means may include one or more pins and holes which correspond to hold the securing means together when the lock device in unlocked. Preferably, multiple levels of locking and securing are used to secure the jewellery items on the keeper body when the securing means is secure.

The lock device may take any suitable form. The lock device may be any suitable clip, lock, clasp or the like. Preferably, the securing means includes a clip or clasp as a lock device that can be closed to secure the jewellery items on the keeper body. Preferably, the clip or clasp may be closed with a push fit. Preferably, the clip or clasp has a release such as a push button. In other forms of the invention the lock device may be omitted and the securing means used alone instead. In this form of the invention the securing means will be secure enough to keep the jewellery items safe on their own. Use of multiple securing or locking devices is preferred to maximise security of the items.

Preferably, a bale is included, swivel mounted to enable the keeper body to be hung from another item. The bale may be used in the usual fashion. For example the bale may be used to suspend the fob, or from a chain as a pendant. Preferably, the swivel mounted bale enables the keeper body to lie flat in any orientation.

Most preferably, the jewellery keeper includes a multi-stage closure to keep the jewellery items safe. For example, the items may pass onto a ring cage, the ring cage closed and then a second closure secure the ring cage closed. Preferably, a two stage closure improves the security of the items on the jewellery keeper. Preferably, the ring cage is formed of arms which form a loop together. The ring cage may provide an easy means capture the jewellery easily and then secured strongly closed to prevent accidental lose.

Accordingly, the present invention provides, in a variant, a jewellery keeper wearable about a person to securely hold jewellery items, the keeper including:

a keeper body including a ring cage;

a wear means on the keeper body adapted to receive one or more jewellery item thereon and maintain them in place and substantially prevent wear through contact with the keeper body;

a securing means including a lock device, to secure the jewellery on the keeper body, and lock it securely such that it cannot be released from the keeper body without operation of the lock device, wherein the one or more items of jewellery are positioned on the keeper body and the lock device of the securing means locks the jewellery in place, so the jewellery is securely held on the keeper body and also held in an attractive presentation for wear by the person.

Accordingly, the invention also relates to a method of use of a jewellery keeper wearable about a person to securely hold jewellery items, the keeper including, a keeper body having a location adapted to receive one or more jewellery item thereon, and a securing means including a lock device, to secure the jewellery on the keeper body, the method including the following steps:

a) open the keeper body up into the unsecured state;

b) thread onto the keeper body one or more jewellery item;

c) close the keeper body into the secured state through securing the securing means and locking the locking means, whereby the jewellery is held in an attractive presentation and substantially prevented from accidental loss.

The method may be reversed to remove the items. The jewellery keeper of the method may be the jewellery keeper of the invention in any of its forms or variants.

INDUSTRIAL APPLICABILITY

The jewellery keeper may be manufactured and then provided to a retailer or to a customer directly.

BRIEF DESCRIPTION OF THE DRAWINGS

The invention will now be described in connection with a non-limiting preferred embodiments with reference to the accompanying drawings, in which.

DETAILED DESCRIPTION OF THE INVENTION INCLUDING A BEST MODE

Figure 1:
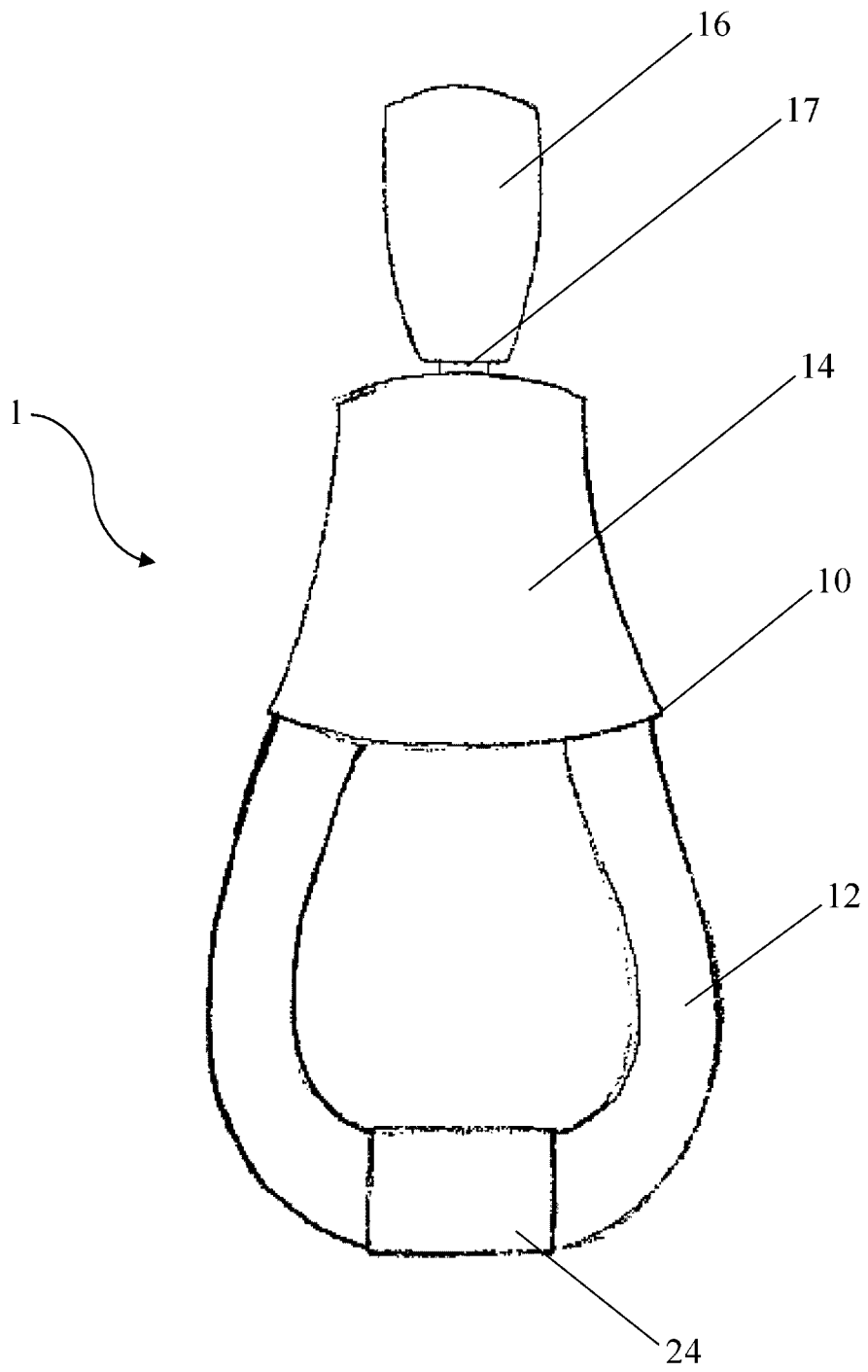
FIG. 1 is a front view a jewellery keeper according to a first preferred embodiment of the invention, with the wear insert and jewellery items both omitted for ease of illustration.
Figure 2:
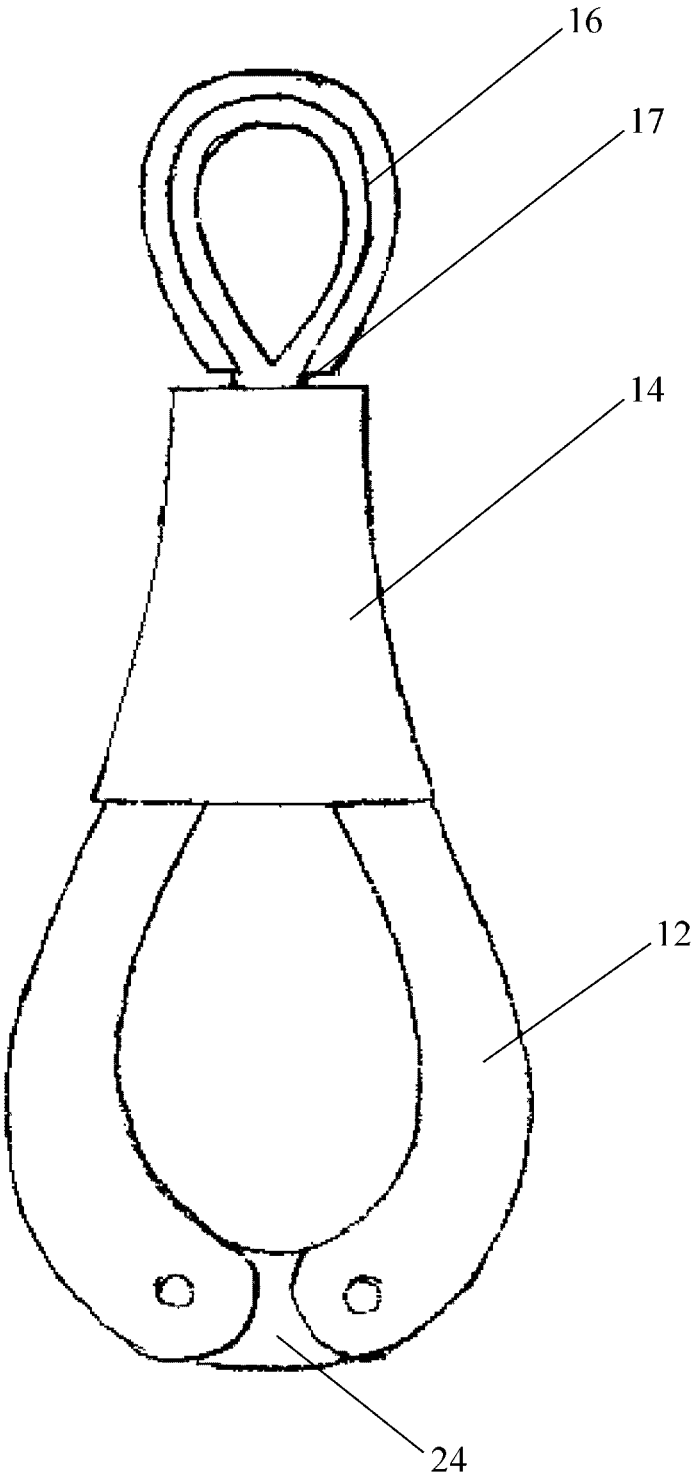
FIG. 2 is an end view of the jewellery keeper of FIG. 1.
Figure 3:
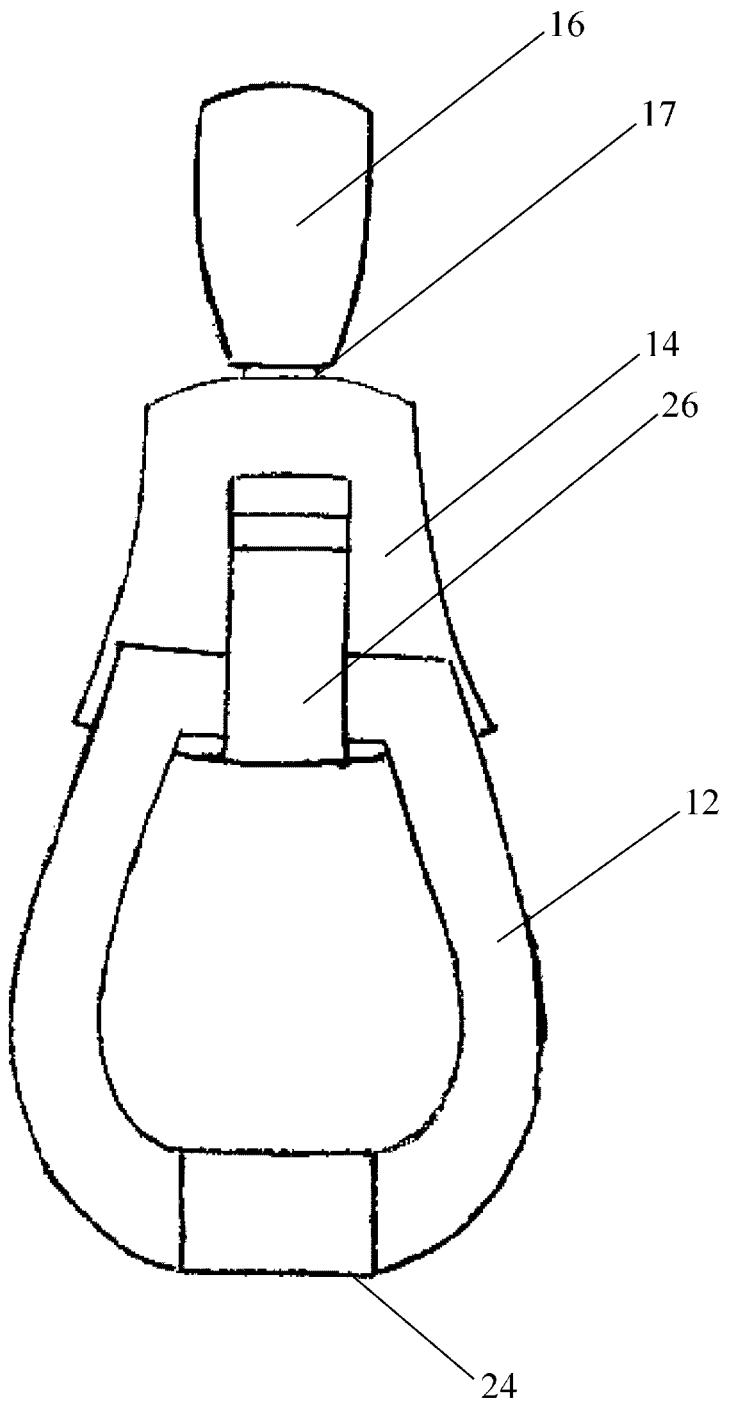
FIG. 3 is a back view of the jewellery keeper of FIGS. 1 and 2.
Figure 4:
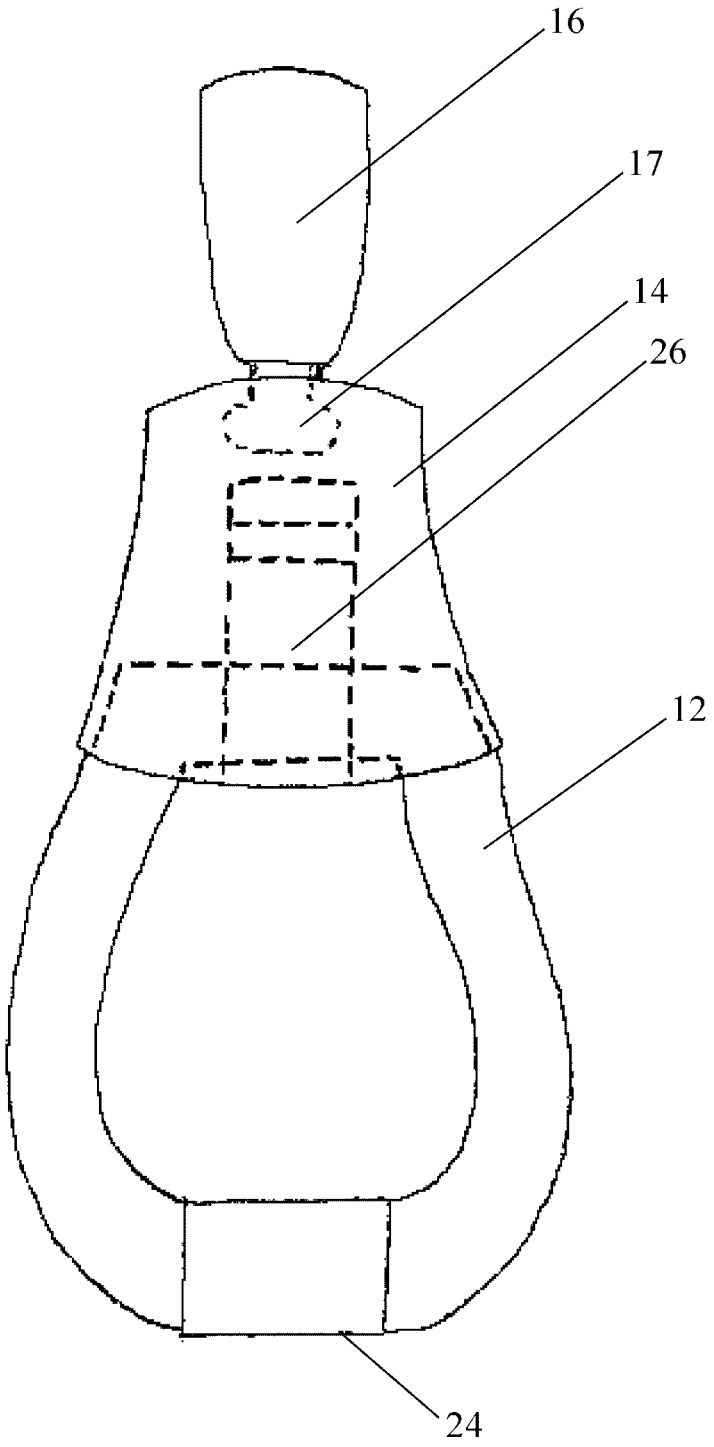
FIG. 4 is the front view of FIG. 1 with the hidden detail shown in dotted lines.
Figure 5:
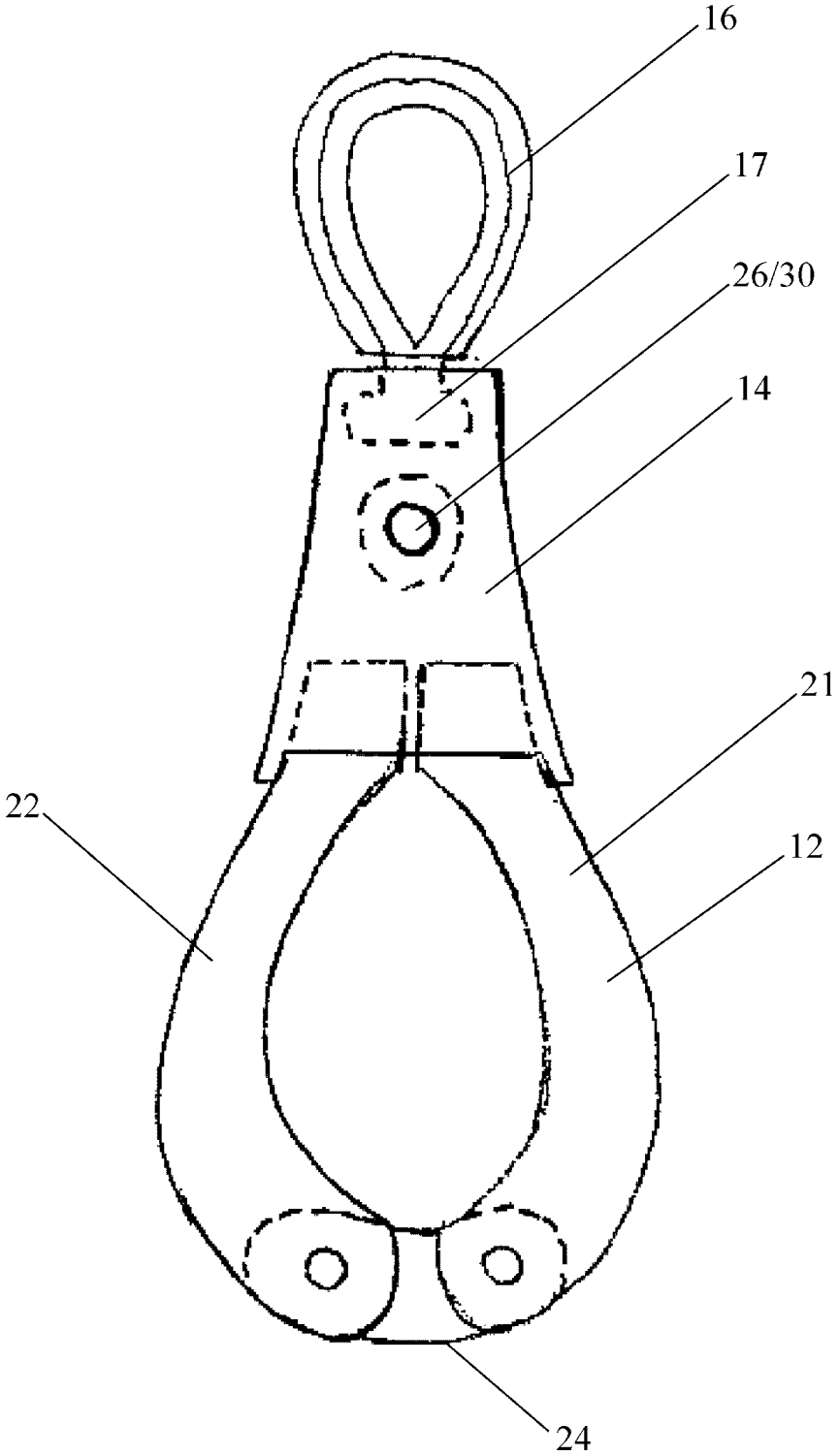
FIG. 5 is the end view of FIG. 2 with the hidden detail shown in dotted lines.
Figure 6:
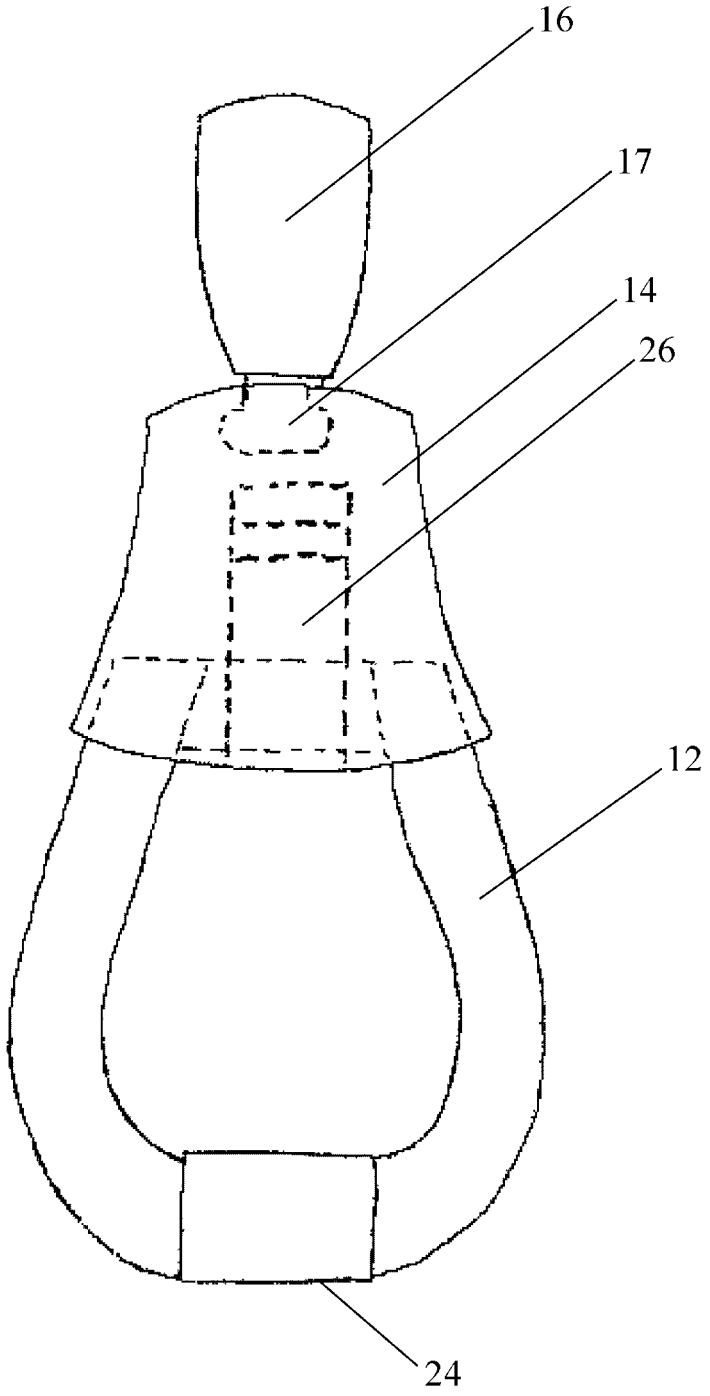
FIG. 6 is a back view of FIG. 3 with the hidden detail shown in dotted lines.
Figure 7:
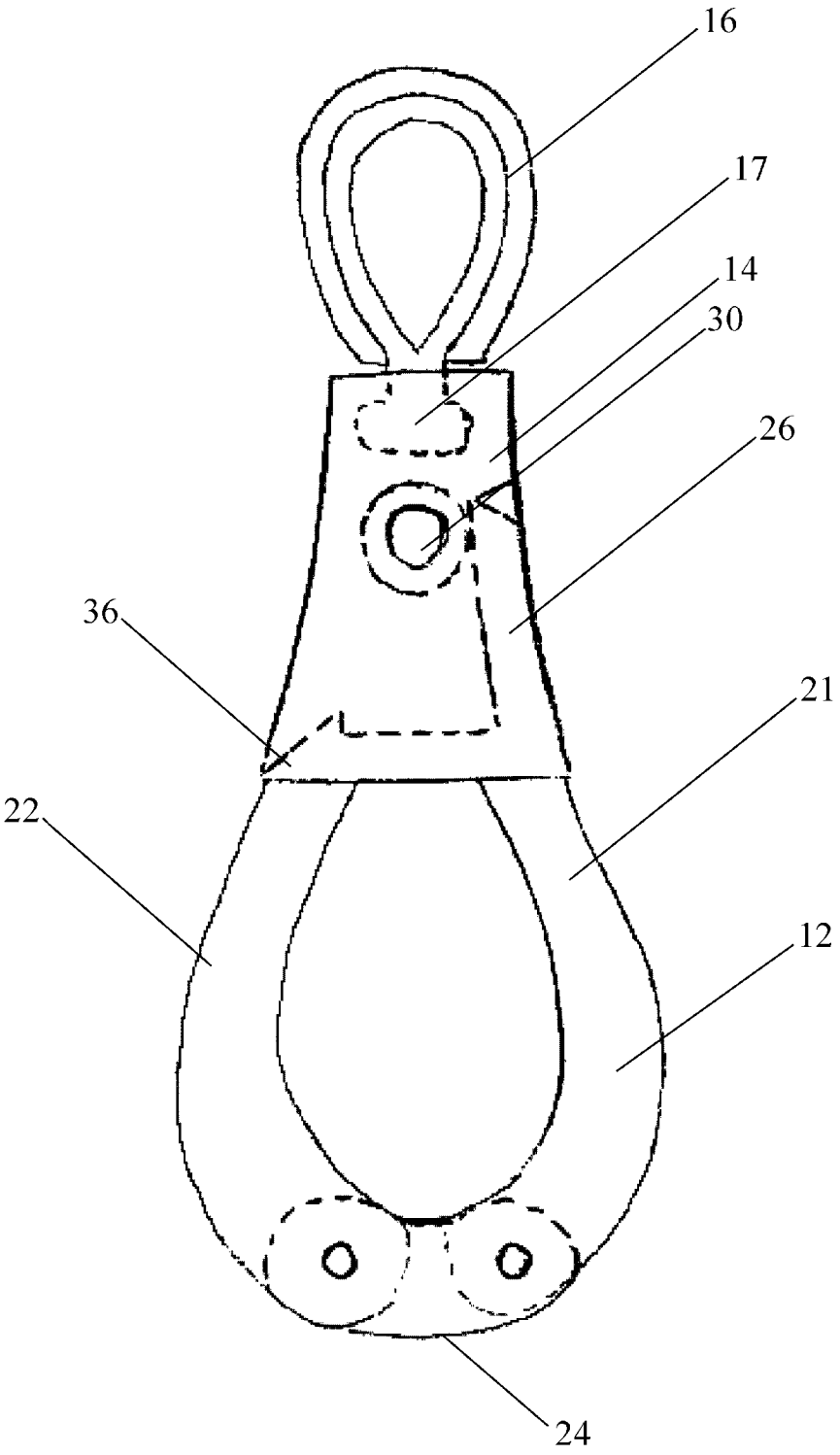
FIG. 7 is the end view of FIG. 2 with the hidden detail of the double catch arrangement shown in dotted lines.
Figure 8:
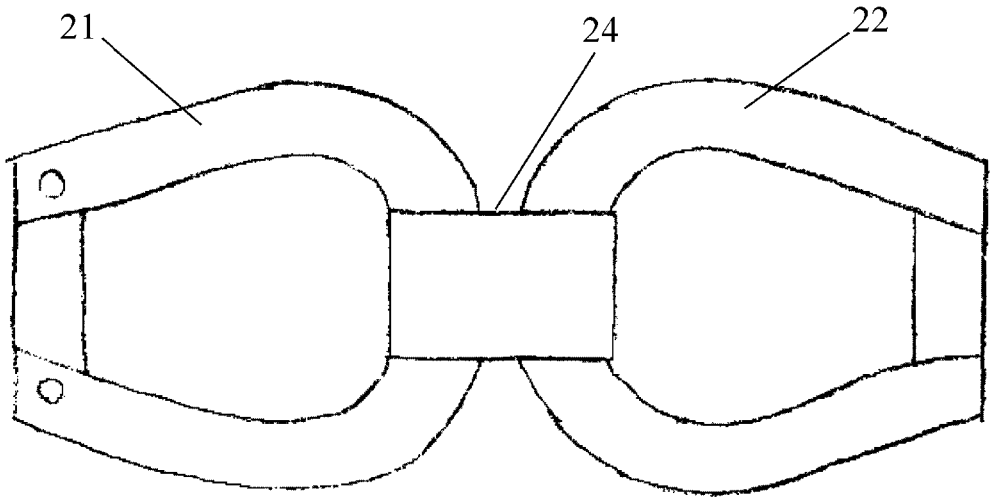
FIG. 8 illustrates a top view of the ring cage of the jewellery keeper of FIGS. 1 to 7, opened out and viewed from above.
Figure 9:
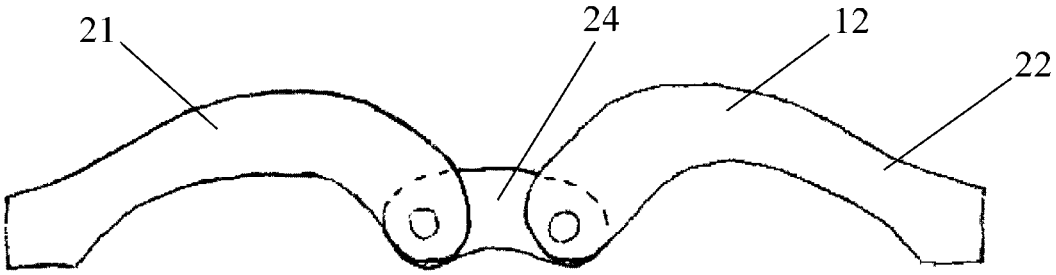
FIG. 9 is the end view of the opened out ring cage of FIG. 8.
Figure 10:
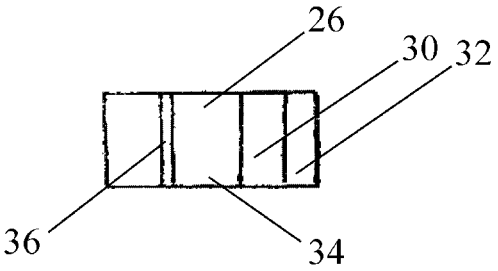
FIG. 10 is a top view of the safety catch of the jewellery keeper of FIGS. 1 to 7.
Figure 11:
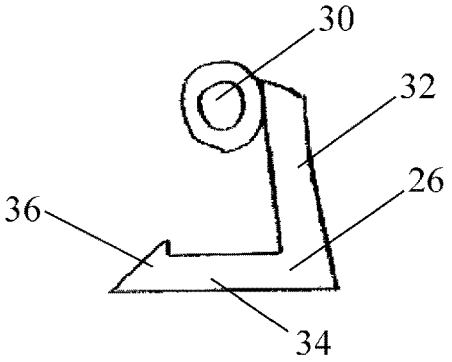
FIG. 11 is the front view of the safety catch of FIG. 10.
Figure 12:
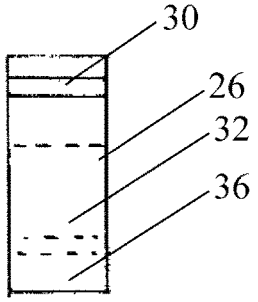
FIG. 12 is the end view of the safety catch of FIGS. 10 and 11.
Figure 13:
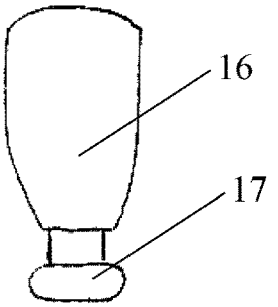
FIG. 13 is a front view of the bale of the jewellery keeper of FIGS. 1 to 7.
Figure 14:
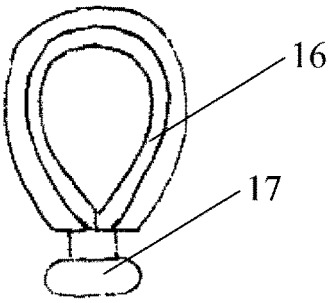
FIG. 14 is an end view of the bale of FIG. 13.
Figure 15:
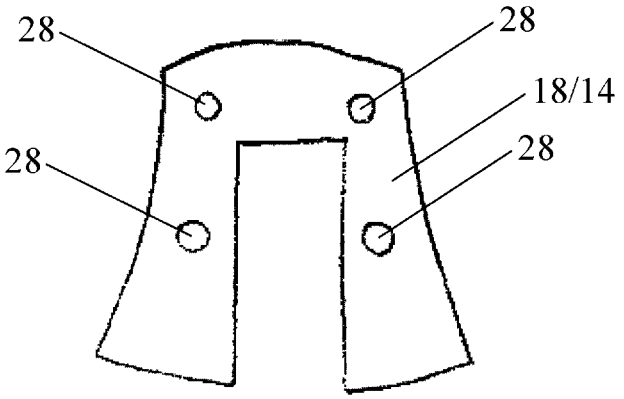
FIG. 15 is a rear view of part of the outer case of the jewellery keeper of FIGS. 1 to 7.
Figure 16:
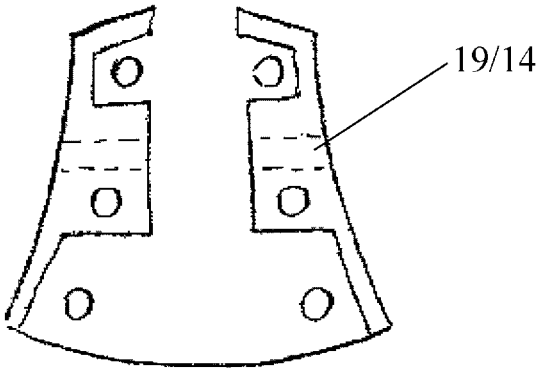
FIG. 16 is a rear view of another part of the outer case of the jewellery keeper of FIGS. 1 to 7, corresponding to the part of FIG. 15.

Referring to FIGS. 1 to 36, a first preferred embodiment of the invention will be described, with two forms of wear insert, a very useful aspect of the invention to act against wear of the jewellery as it is held within the keeper. The remainder of the invention is the same throughout the FIGS. 1 to 36, and the jewellery removed to show the details of the jewellery keeper clearly; except for FIGS. 31 to 36 where the rings are included to show the invention in use.

Jewellery keeper 1, is designed to be useful to hold rings, engagement ring 2, wedding ring 3 and keeper ring 4, for example (refer FIGS. 31 to 36 for the rings). Jewellery keeper 1 is easier to see in the earlier drawings with the rings (2, 3 and 4) omitted to show the features, and as illustrated includes body 10, including ring cage 12 and secure closure 14; it is the secure closure that holds the jewellery in place. Bale 16 allows jewellery keeper 1 to be hung on a fob, or worn as a neck pendent, as desired by the person. Bale 16 is designed to have a coordinated look with the rest of the item. Bale 16 is mounted on swivel 17, swivel 17 being particularly useful to enable 360 degrees of rotation. Use of swivel 17 enables jewellery keeper 1 and the contained jewellery items to sit flat in all user conditions. As a fob or pendant to sit flat, comfortable and practical while working is a very useful aspect of the invention.

The illustrated jewellery keeper 1 is made of gold-plated metal that is strong, with an attractive finish. Variants to the materials used may be made as these may match or highlight the material of the rings of the person, so as to present as a very attractive item in combination with the rings. Use of precious metals is preferred for the high end product, and so gold, silver and other precious metal or plate metals may be used. A suitable steel could be used instead or a combination of suitable materials. In one form of the invention the materials may be metal and or plastic suitable for sports and ease of cleaning for example. As illustrated an everyday wear form of the invention shown, of a gold-plated arrangement so as to display a gold wedding ring set (not shown) to the maximum attractive appearance. Jewellery keeper 1 can be provided plain, be highly decorated, or be decorated particularly for the customer to highlight the rings to be displayed. Engraving of words, or patterns may be included to decorate the item, and in the high end product precious gems may also be mounted on body 10, including on secure closure 14. Plain or decorated jewellery keeper 1 is designed to be attractive in its own right and also in combination with the rings of the person.

Figure 17:
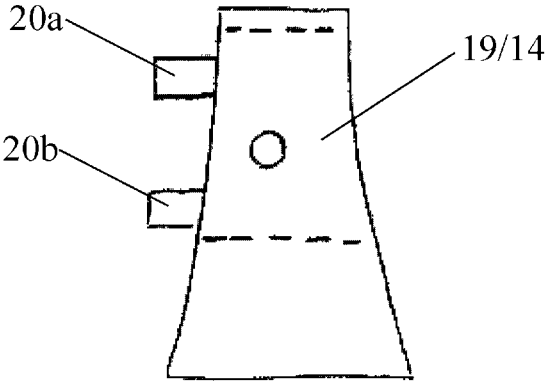
FIG. 17 is an end view of the outer case of FIGS. 15 and 16.
Figure 18:
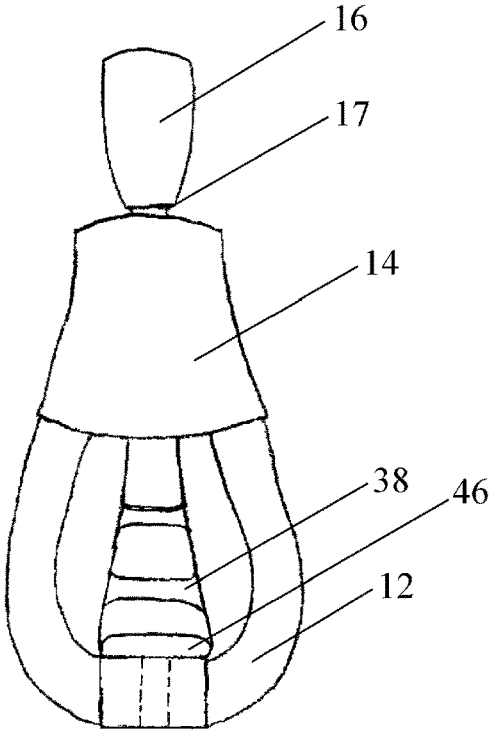
FIG. 18 is a front view of the jewellery keeper of FIGS. 1 to 7, with a separated wear insert in place.
Figure 19:
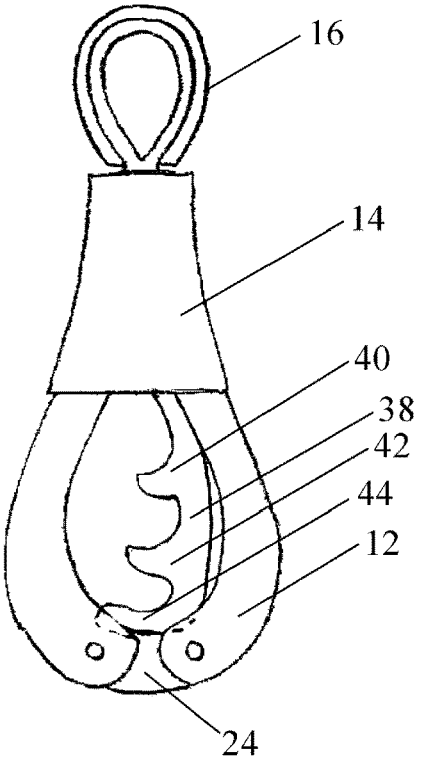
FIG. 19 is an end view of the jewellery keeper and separated wear insert of FIG. 18.
Figure 20:
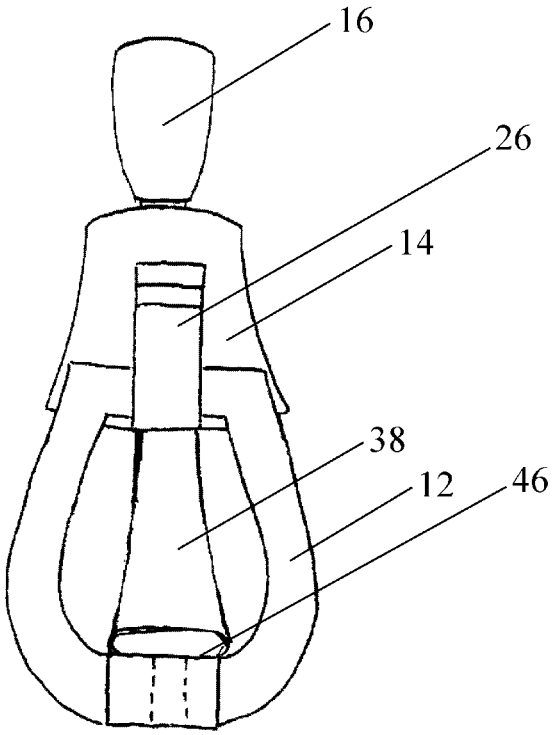
FIG. 20 is a rear view of the jewellery keeper and separated wear insert of FIGS. 18 and 19.
Figure 21:
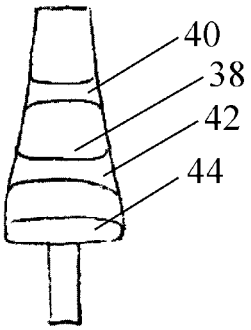
FIG. 21 a front view of the separated insert of FIGS. 18 to 20.

Secure closure 14 has two parts 18 and 19 which close firmly together in use to secure ring cage 12 closed and any rings or jewellery in the ring cage be kept in place. Pins 20*a* and 20*b* on part 19 as can be seen in FIG. 17, correspond to holes 28 in part 18 so that these can snap together. Ring cage arms 21 and 22 are hinged by ring cage hinge 24 so as to open up or close together. The rings can be easily placed over an arm 21 or 22, and these arms be brought together and secured through safety catch 26 of secure closure 14. In this way the rings, are held in the ring cage and hang down securely resting on the wear insert, see below.

To secure the rings on ring cage 12, secure closure 14 parts 18 and 19 are brought together and the aligned rivets connect (pins 20*a* and 20*b* into holes 28) but the locking occurs through use of safety catch 26 as can be seen in particular in FIGS. 3, 4, 6, 7, and 10 to 12. Safety catch 26 has first part 30, second part 32 and third part 34 each forming an L-shaped arrangement with pointed catch 36. A spring (not shown) for safety catch 26 is contained within security closure 14, and pressing allows catch 36 to catch into place within security closure 14 and be held in place.

To open up jewellery keeper 1, a fingernail can be used to lift the latch from behind, similar to the latch on a ladies' dress watch or bracelet. The structure of the clasp is a self-locking hook that is pressed together, to strongly hold in place until the latch is lifted up and the catch released.

Two wear inserts are described, separated wear insert 38, with hooks 40, 42 and 44 (refer FIGS. 18 to 22) and flat wear insert 46, with top 48 and base 50 (refer FIGS. 23 to 29). Both sit in ring cage 12 to support rings 2, 3 or 4 and prevent wear. Wear insert 38/46 are used as important protection for the jewellery items. The jewellery items could be scratched or scuffed easily if held by a hard metal. Therefore, a soft metal wear insert has been developed on which the contact point of the rings rests. Wear insert 38/46 is configured to be a softer material so the wear insert wears, rather than damage occurring to the rings themselves. With these valuable pieces of jewellery, it is imperative that no damage occurs to the rings or the invention is unlikely to be used at all.

Figure 22:
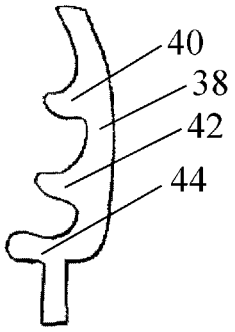
FIG. 22 is an end view of the separated insert of FIG. 21.
Figure 23:
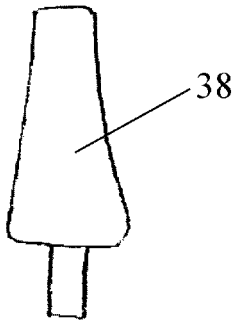
FIG. 23 is a rear view of the separated insert of FIGS. 21 and 22.
Figure 24:
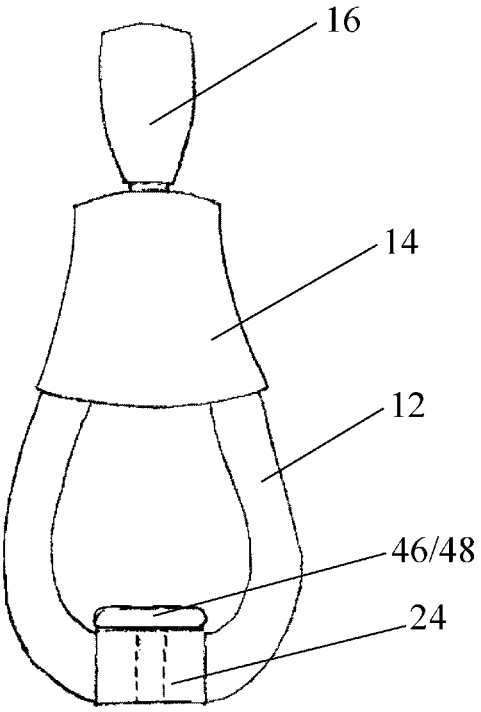
FIG. 24 illustrates the front view of the jewellery keeper of FIGS. 1 to 7, with a different wear insert in place, this time a flat wear insert.
Figure 25:
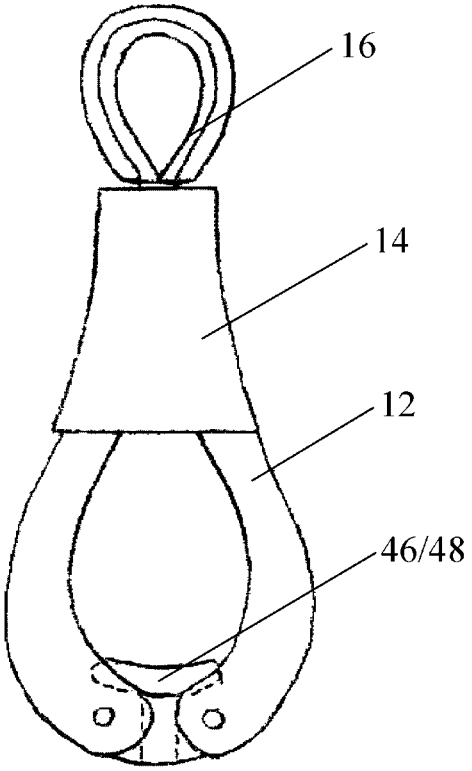
FIG. 25 is an end view of the jewellery keeper and flat wear insert of FIG. 24.
Figure 26:
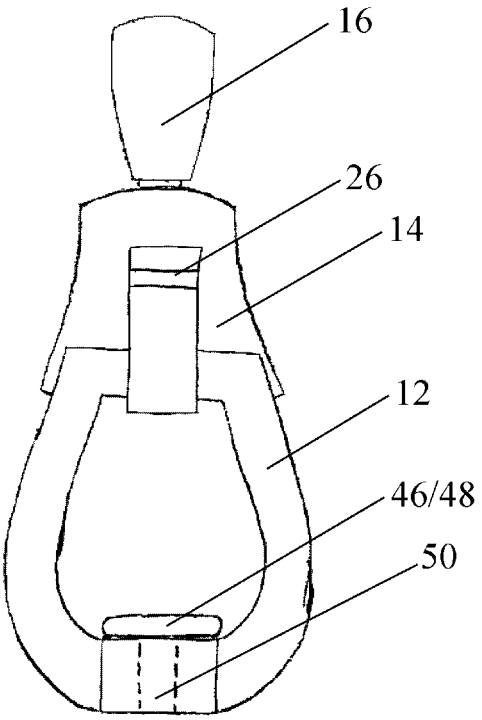
FIG. 26 is a rear view of the jewellery keeper and flat wear insert of FIGS. 24 and 25.
Figure 27:
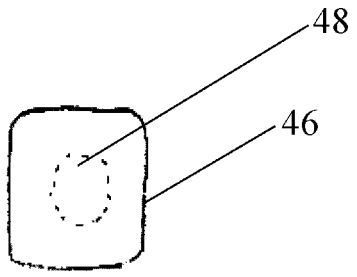
FIG. 27 is a top view of the flat wear insert of FIGS. 24 to 26.
Figure 28:
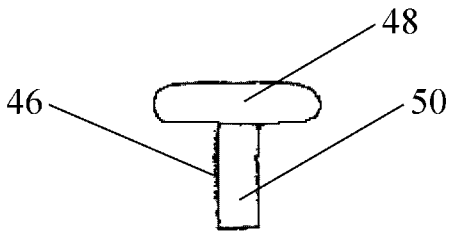
FIG. 28 is a front view of the flat wear insert of FIG. 27.
Figure 29:
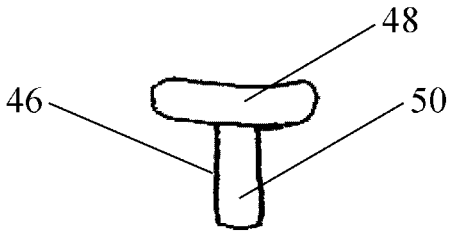
FIG. 29 is a side view of the wear insert of FIGS. 27 to 28.
Figure 30:
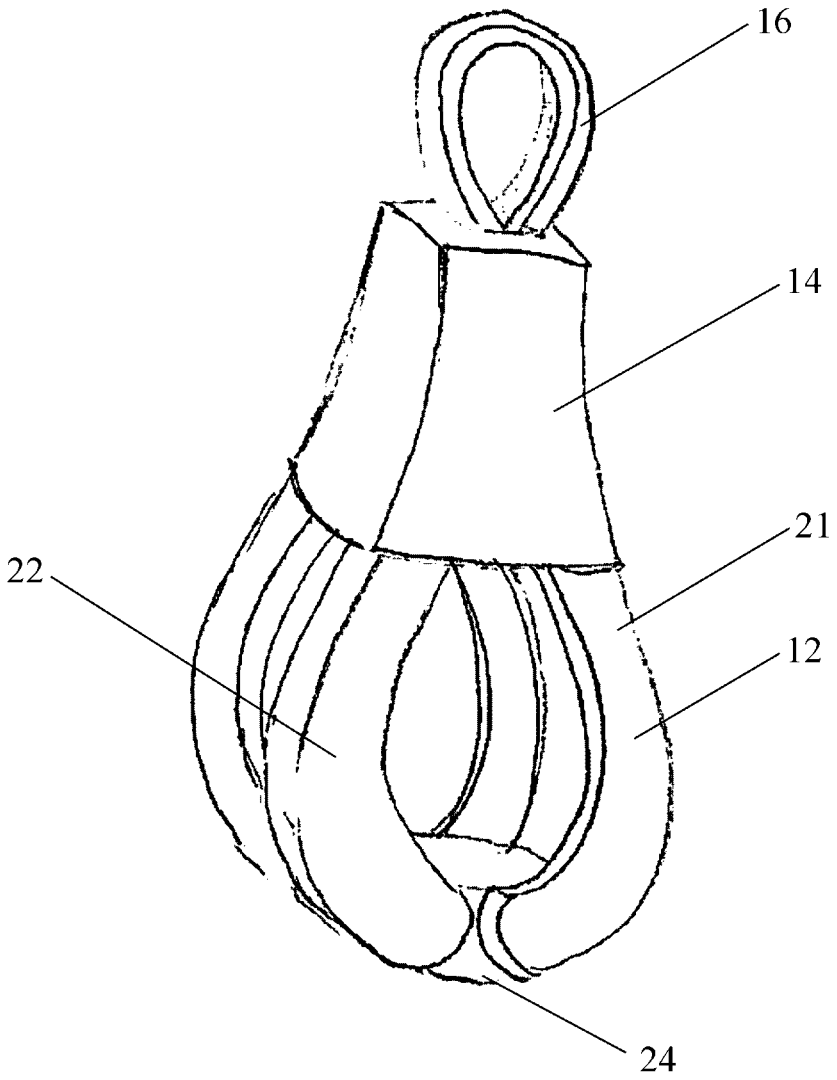
FIG. 30 is a perspective view of the jewellery keeper of FIGS. 1 to 7.
Figure 31:
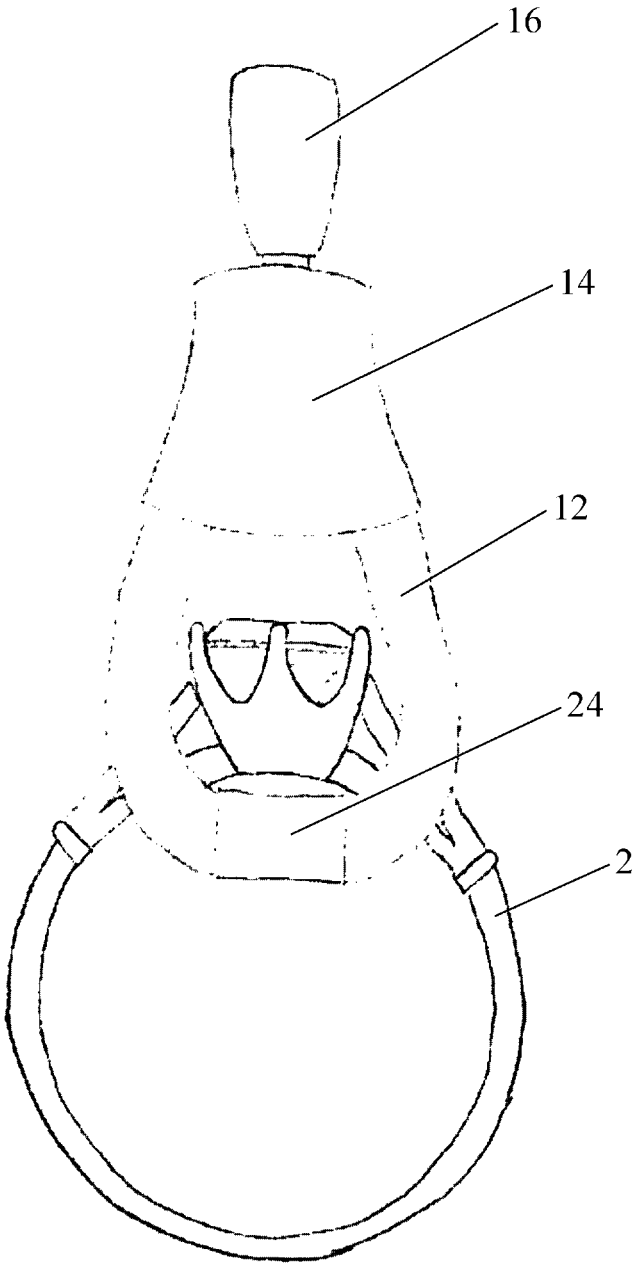
FIG. 31 is the front view of the jewellery keeper of FIG. 1, holding an engagement ring in an upright position.
Figure 32:
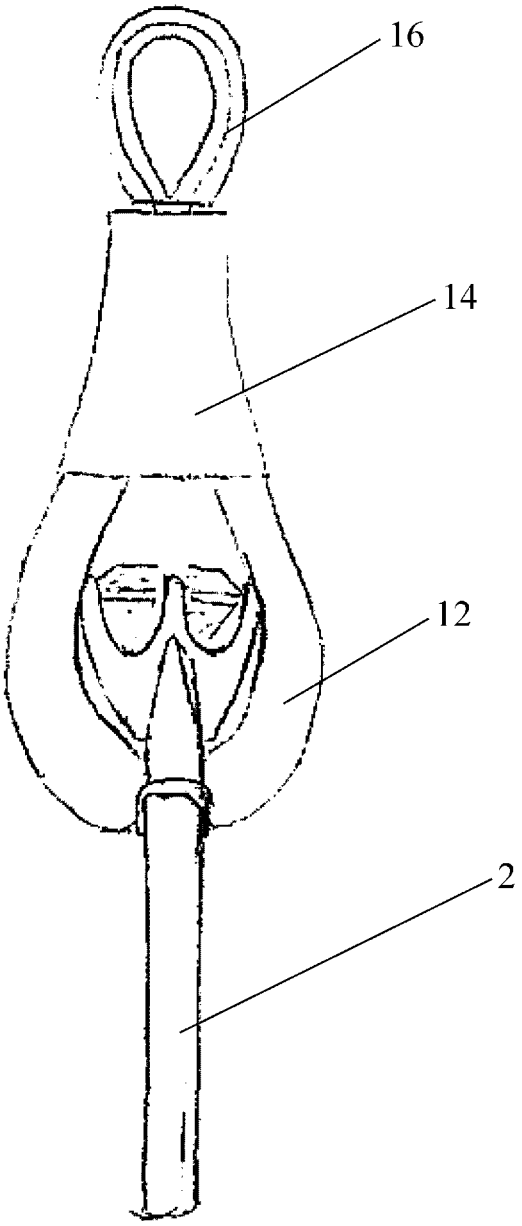
FIG. 32 is a side view of the jewellery keeper and engagement ring of FIG. 31.

Wear insert 38 is designed to hold 3 separate rings securely in the wear insert, and held on jewellery keeper 1. The wear insert can be adapted to have 1, 2, 3 or even more hooks each to hold and separate the rings to keep them safe (refer FIGS. 35 and 36 for example). As illustrated wear insert 38 includes 3 hooks, 40, 42 and 44 and each of these can hold a separated ring. Wear insert 38 is designed to protect the jewellery item from scratching or wear when held in place but also the clever design prevents the rings from rubbing or scratching against one another. There may be two rings of one material, an engagement ring and wedding ring say, and a third precious ring of a completely different material. Family rings are precious and often passed through the generations but are unlikely to be the same material as a modern wedding set. To protect from wear amongst these rings too, use of the separated wear insert 38 is particularly useful as each ring can hook on and the point of contact, the point where most wear will occur will be divided. Each ring is hooked on hook 40, 42 and 44 so as to be presented attractively together but each held safely and securely. As shown in FIG. 22 the hooks are inclined and stacked to present the rings one on top of the other, separated and presented attractively (refer FIG. 19), as well as being protected from wear.

The orientation shown presents the rings in a simple form of the invention to hang down, below ring cage 12. These rings are held so that they each present the main jewels attractively in a staggered arrangement. In another form of the invention, the separated wear insert can be used with the rings placed so that the stone of the ring is presented uppermost. The shape of the wear insert may be manipulated to hold the rings in a suitable manner so that, a stone such as the main diamond of an engagement ring is presented uppermost, as a highlight. The wear insert and jewellery keeper can include multiple parts to hold safely different rings in different ways to present a very attractive pendent or fob using the rings in an alternative fashion. Presentation of a solitaire diamond ring foremost for example, would enable the person to carry and show the valuable stone at all times, keeping safe and secure and with the person, even when the ring is not able to be worn on the hands. Ornamentation of jewellery keeper 1 can further be made with use of other precious metals and gemstones, to enhance the presentation.

An alternative wear insert, flat wear insert 46 is illustrated in FIGS. 23 to 29, suitable for the rings to sit together on the wear insert, preventing wear. Flat wear insert 46 has a flat top 48 which fits well into ring cage 12. Held in place wear insert 46 allows the rings to rest on this point, and avoid wear.

The invention describes a clever new way to carry more than one jewellery item, securely, to prevent wear and in a way that the jewellery can be presented attractively. A person may be getting ready to start work, perhaps a nurse, and so they will easily remove their rings and while wearing the fob open catch 36, separate parts 18 and 19 and open up ring cage 12, the rings are removed from the finger and slipped over an arm of ring cage 12 and put on similar to the arrangement as worn. If the separated wear insert is used each ring can quickly be hooked on in the desired order, having been hooked on one at a time. The process can then be reversed ring cage arms 21 and 22 pushed closed, so pins and rivets 20*a*, 20*b* and holes 28 align and catch 36 catches firmly in place. The whole of secure closure 14 is then fixed in place and ring cage 12 closed capturing the rings. The rings cannot be removed from ring cage 12 unless secure closure 14 is released. Catch 36 is designed to be strong and suitable for maintaining precious items. To be released, as described above using a fingernail to the lift and release the latch must be undertaken, which then allows pins rivets 20*a*, 20*b* and holes 28 to be pushed apart again separating parts 18 and 19 so that the secure closure may be opened. If catch 36 could become undone, this is unlikely but during the process pins 20*a* and 20*b* in holes 28 will continue to maintain secure closure 14 in place and rings on ring cage 12 until pushed apart.

Referring in particular to FIG. 31 to FIGS. 34, the invention is shown with engagement ring 2. Engagement ring 2 is shown as a diamond solitaire, a typical engagement ring. Often an engagement ring is the most valuable item of jewellery a person owns, and is also wanted to worn daily, preferably on display. As discussed elsewhere, it is desirable not only to keep the valuable engagement ring safe, but also preferably on display. Engagement ring 2 is displayed in the upright position in FIGS. 31 and 32, so that the attractive head of the ring is displayed in the ring cage, again in an overall attractive appearance, the stone held centrally. In this way the central stone of engagement ring 2 is displayed as worn within jewellery keeper 1. Engagement ring 2, is a valuable ring and again it is important that it is not damaged at all during being held in jewellery keeper 1. To prevent damage to ring 2, wear plate 24 supports the contact points of the ring and being a softer metal will wear on contact so that the ring itself is not damaged. Looking a FIG. 32 it can be seen that the head of engagement ring 2 sits comfortably within the ring cage and sits well on wear plate 24.

Figure 33:
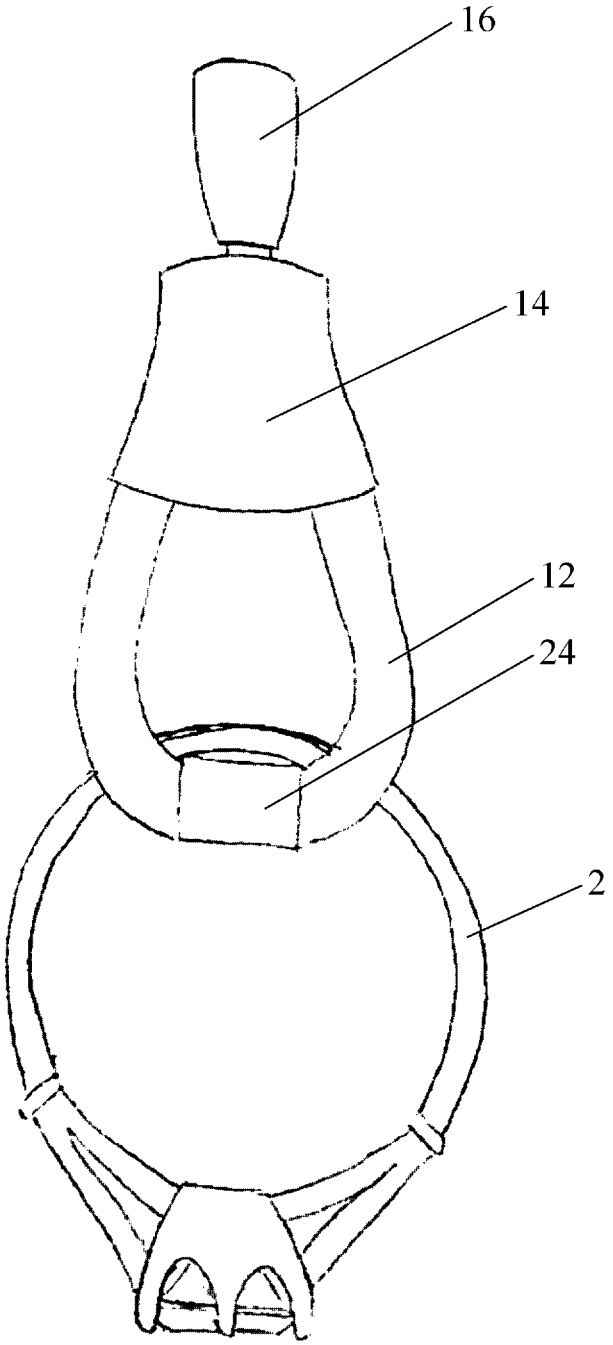
FIG. 33 is the front view of the jewellery keeper of FIGS. 1 and 31 with the engagement ring in the hanging position.
Figure 34:
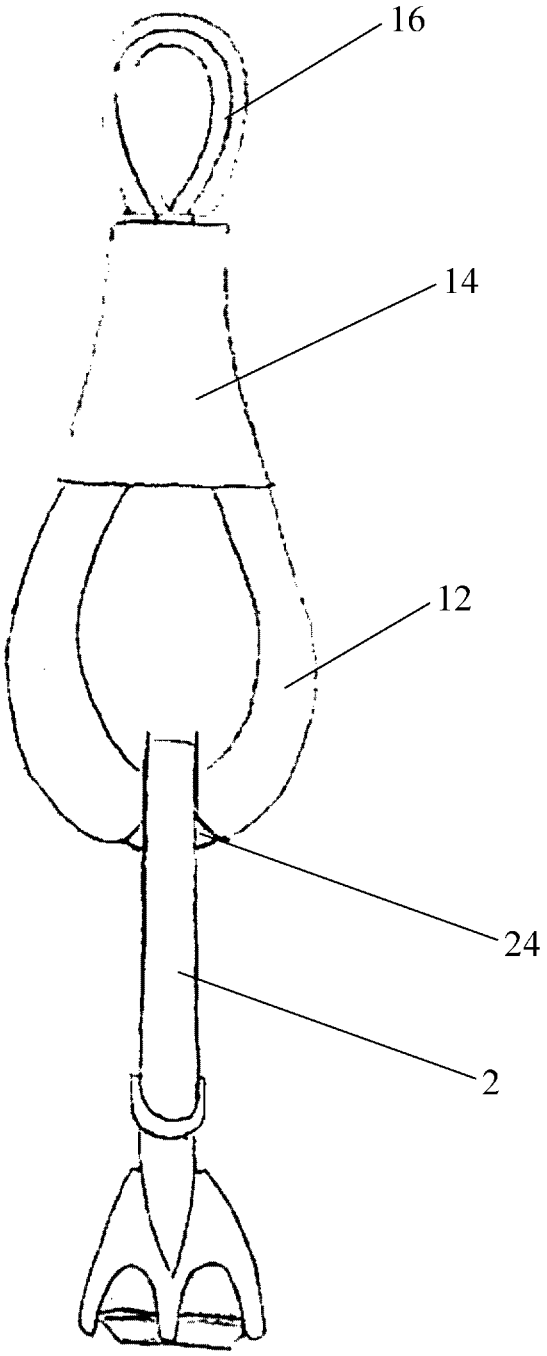
FIG. 34 is the side view of the jewellery keeper and hanging engagement ring of FIG. 33.

The method of wearing the jewellery in jewellery keeper 1, is a matter of choice, which may be upright or hanging down, and can be varied to wear the jewellery in different circumstances. In FIGS. 33 and 34 jewellery keeper 1 is worn with engagement ring 2 hanging down below so the main stone is visible in a different manner. Again wear plate 24 provides protection to the ring hanging down as the wear plate will wear, not the ring.

For some situations, not all rings will need to be removed, for example a wedding ring that does not project above the finger, may be allowable to wear in some circumstances whereas engagement ring 2 could be a cutting risk or inconvenient to wear while performing some tasks. So engagement ring 2 could be kept safe in jewellery keeper 1, while, in these circumstances other rings are worn as usual.

However, in many circumstances and such as medical treatments or surgery it is desirable to remove all rings and keep these safe.

Figure 35:
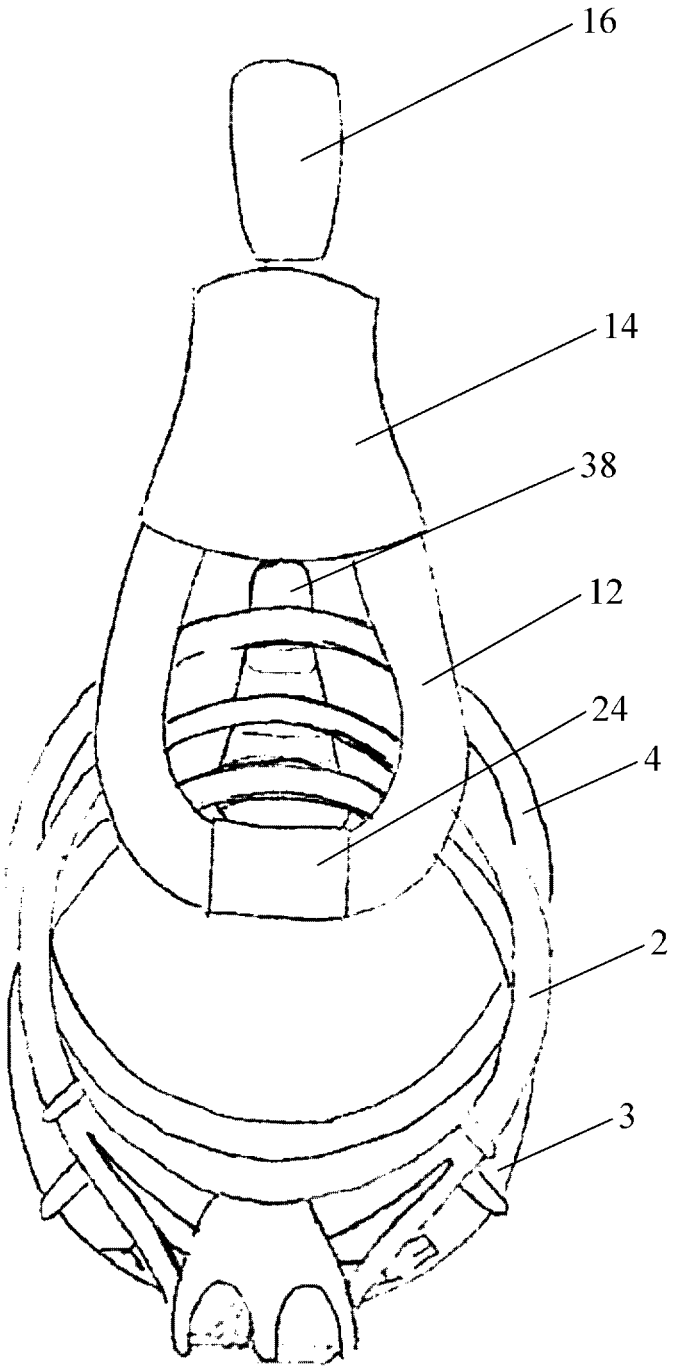
FIG. 35 is a front view of the jewellery keeper of FIGS. 18, 19 and 20 including a separated wear insert, with engagement ring, wedding ring and keeper ring being held attractively in the hanging orientation.
Figure 36:
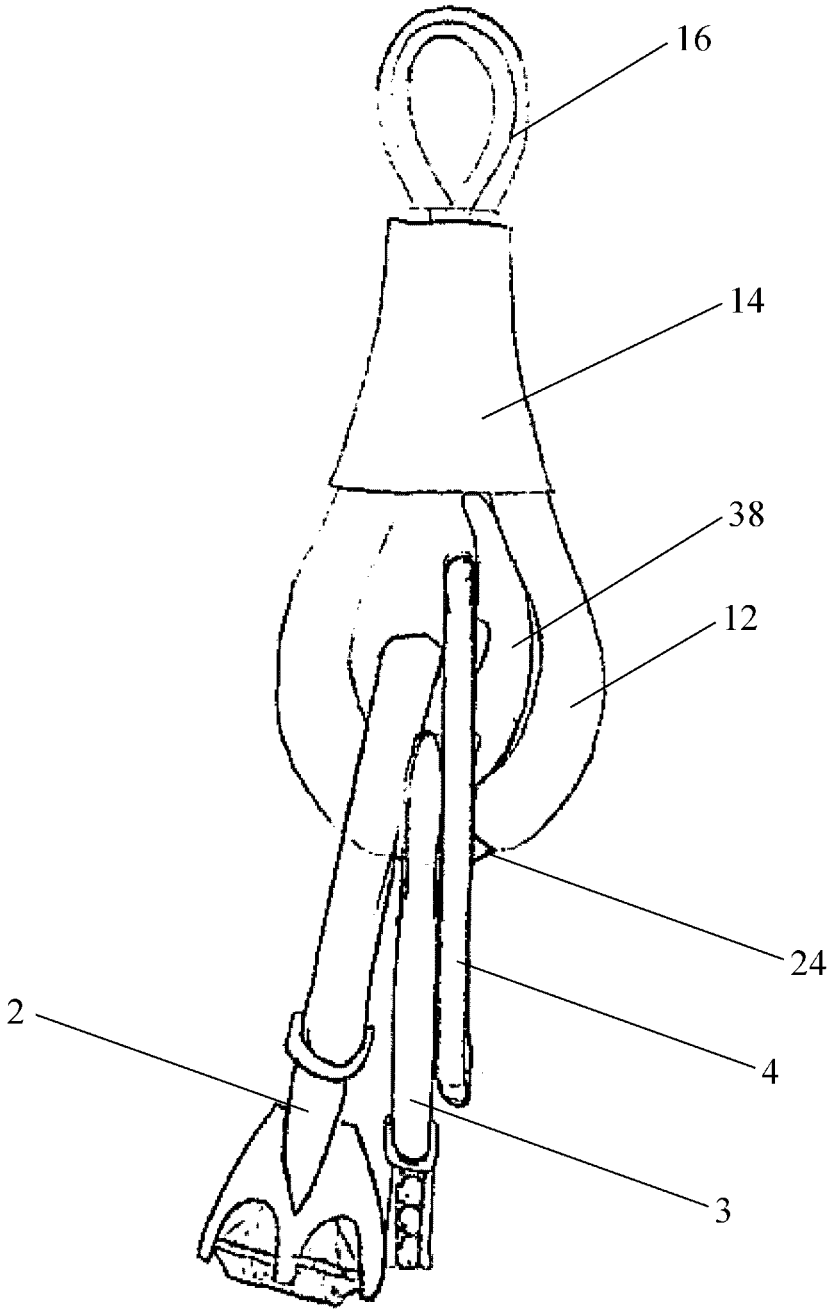
FIG. 36 is a side view of the jewellery keeper of FIG. 35 with three rings.

Referring to FIGS. 35 and 36 engagement ring 2 is held in separated wear insert 38, with rings 3 and 4 also held in place. Each ring sits on separated wear insert 38 to support and separate these, held secure and to contact wear insert rather than other materials. Again the arrangement is designed to hold rings 2, 3 and 4 each sitting on separated wear insert 38 so that any wear occurs to the replaceable insert and no damage occurs to the rings themselves.

As described, the jewellery keeper is used on a nurse fob (not shown) but in another form the invention is used with a very strong chain. Use of the strong chain, formed of a very high quality standard provides a secure and safe arrangement that a person can be confident will keep the jewellery safe until deliberately removed. The whole package can then be supplied to the customer, a ring keeper that will not damage the rings and can be securely kept on the keeper and the keeper strongly on a strong chain to be worn about the neck.

The multiple levels of security give the wearer comfort that the items are secure until released, the person also has comfort in having the items with them at all times. The invention can be varied to suit different tastes and requirements as would be understood, and is likely to be very well received in a number of professions. Although some attempts have been made to find a way to hold safely jewellery items while they cannot be worn on the hand, these have all suffered draw backs, and can only carry a single item, are complex, unattractive and lead to damage and wear to the items which is clearly not desirable. The subject invention enables a practical and attractive way for a person to keep their jewellery safe and on display in situations where no jewellery can be worn on the hands.

Although rings 2, 3, and 4, are described any suitable pieces of jewellery or other precious items that can be contained by the ring cage can be held on instead.

Clearly, the invention is a very useful and attractive way to hold, present and carry jewellery items is a secure manner.

Figure 37:
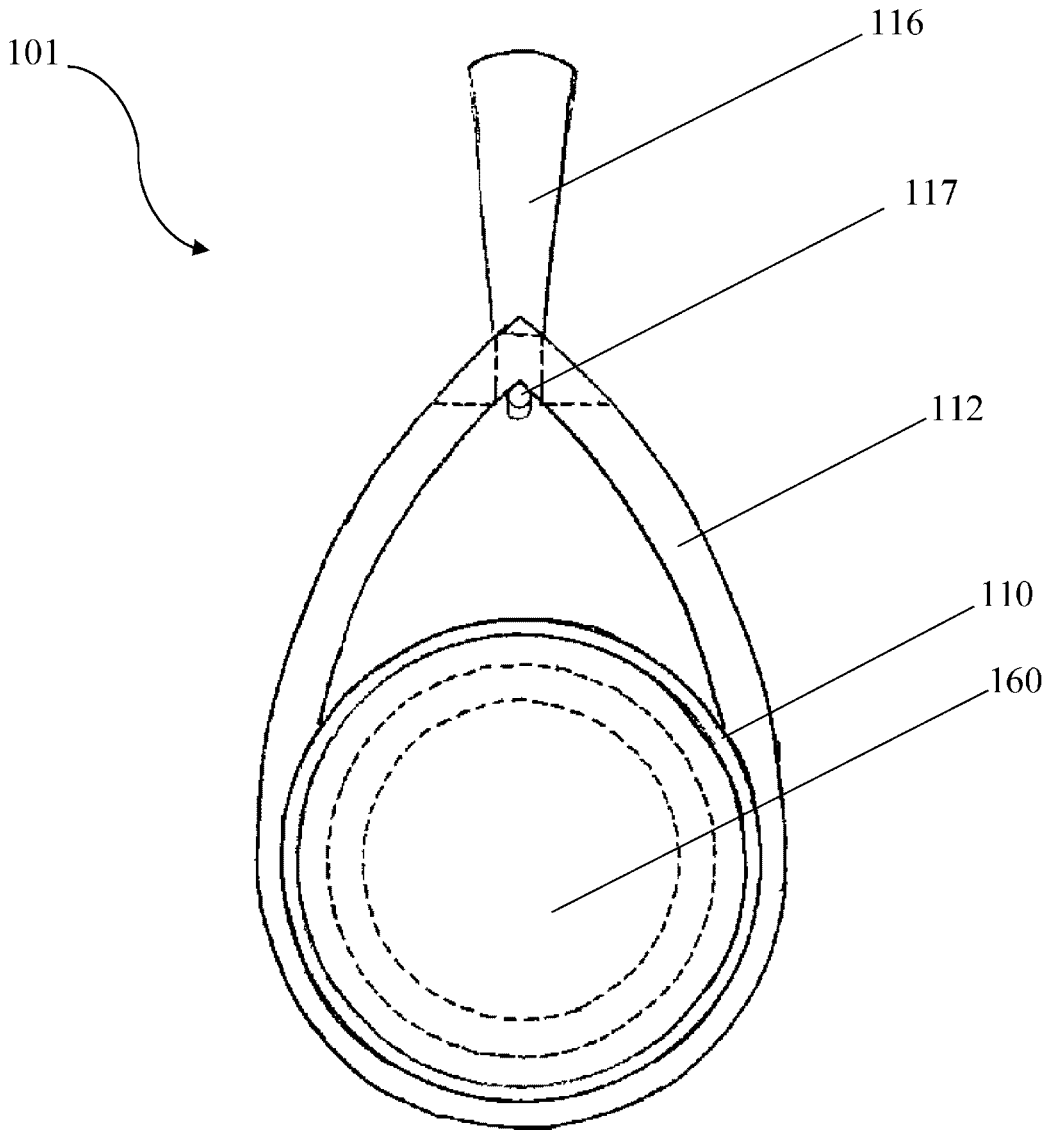
FIG. 37 is a front view of a jewellery keeper according to a second preferred embodiment of the invention.
Figure 38:
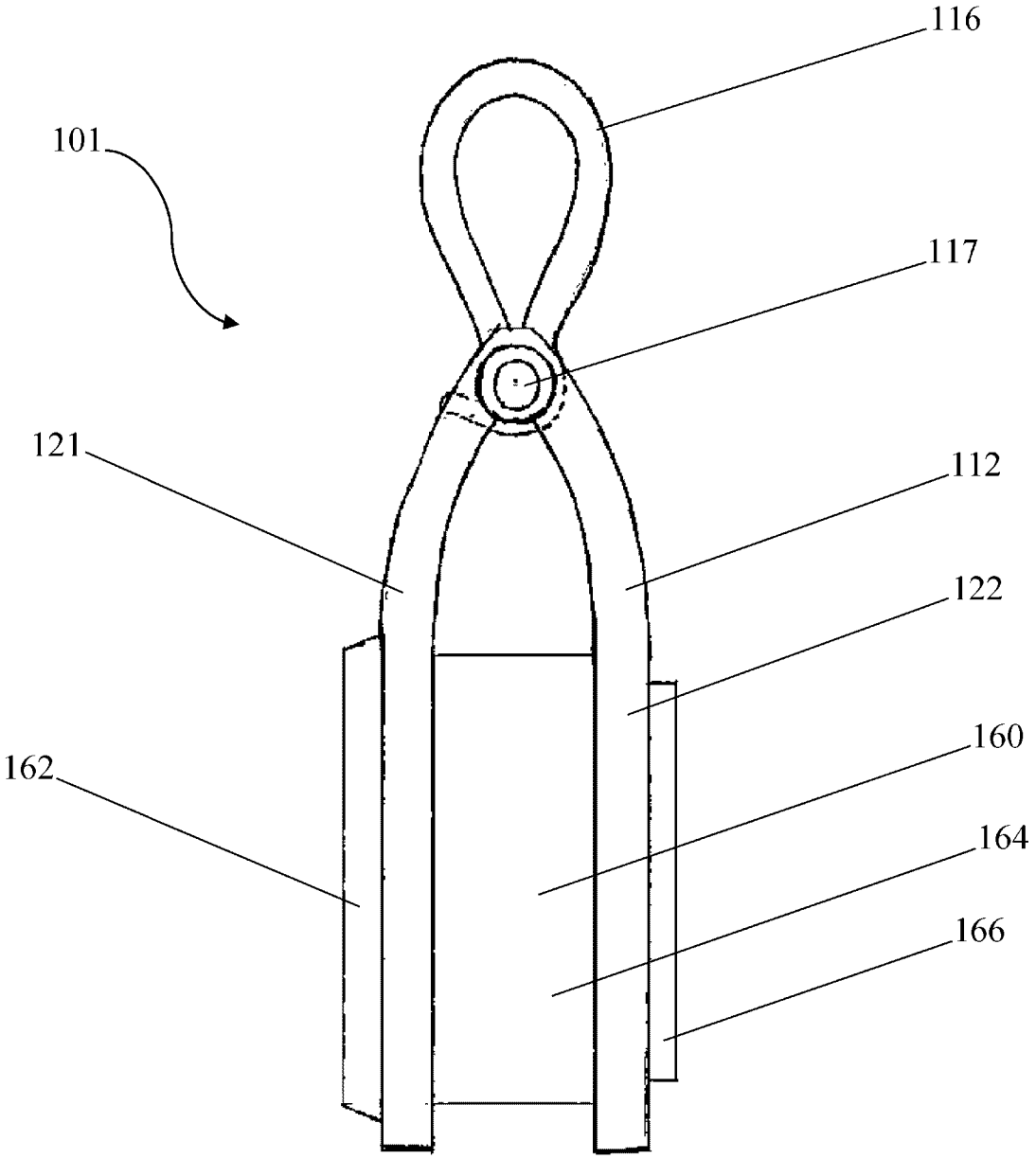
FIG. 38 is a side view of the jewellery keeper of FIG. 37.
Figure 39:
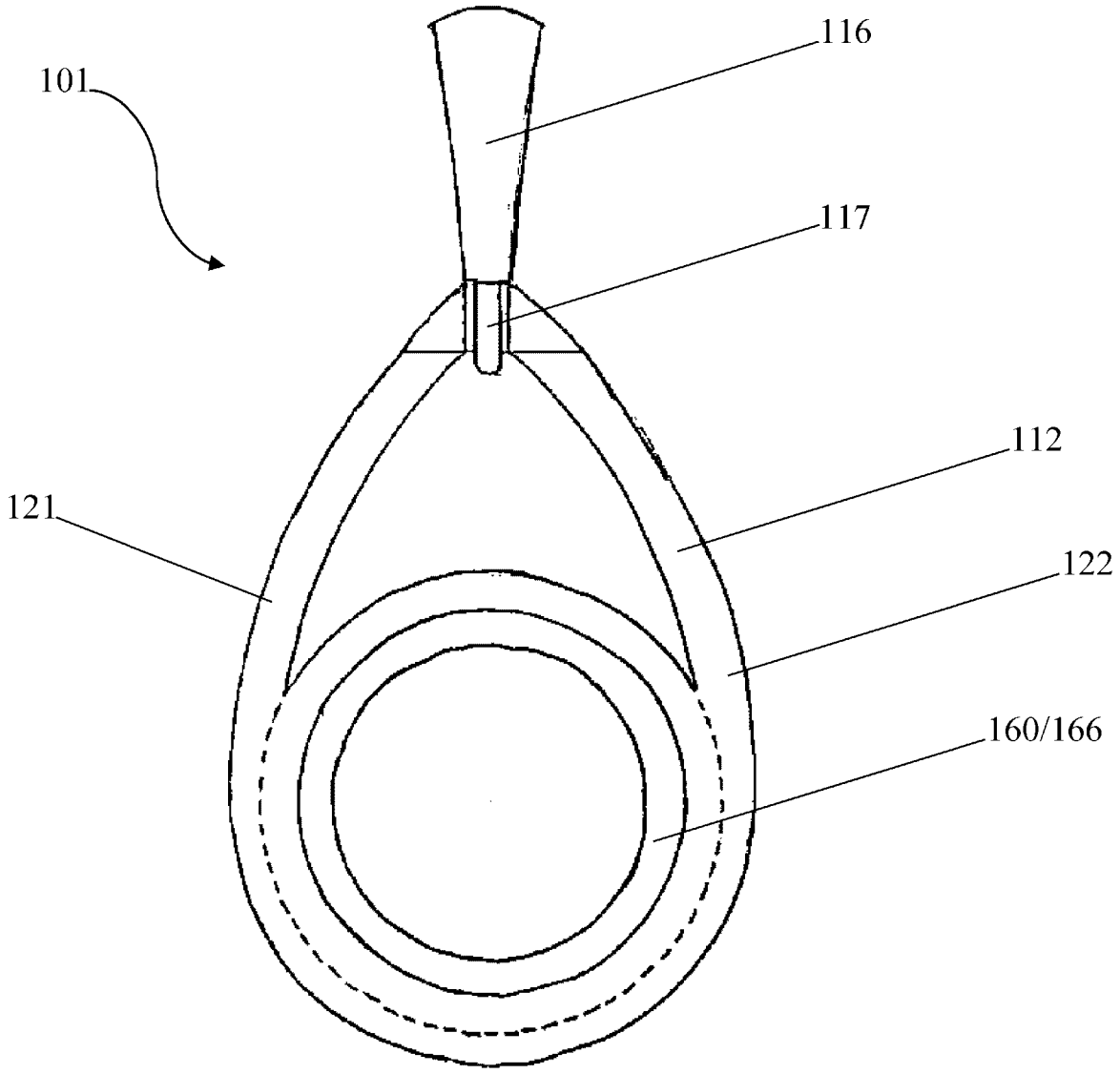
FIG. 39 is a rear view of the jewellery keeper of FIGS. 37 and 38.

Referring to FIGS. 37 to 39, a second preferred embodiment of the invention will be described, with jewellery keeper 101, with a sleek, modern, attractive appearance with a straightforward, smooth method of use. Jewellery keeper 101 is very similar to jewellery keeper 1, and offers the same advantages and method of use, excepting generally that the closure and holder is simplified into an improved elegant design.

As for jewellery keeper 1, jewellery keeper 101 is designed to securely hold items of jewellery, for times when a person is unable or does not wish to wear the rings. This may be when working, working with their hands, or for other reasons when the rings cannot be worn but it is desired to wear them and keep them close in another way.

Jewellery keeper 101 as illustrated includes body 110 and ring cage 112 similar to the first embodiment, on which the rings are held and secured. Bale 116, is a large free moving bale, mounted on swivel spring 117. Use of bale 116 and swivel spring 117 enables jewellery keeper 101 to be suspended in any of the usual manners, as a nurse's fob, pendent, or on a key fob or chain. The clever design allows a significant degree of attractive and useful articulation at bale 116 and swivel spring 117, while body 110 can lie flat against the body or a surface, so that jewellery keeper 101 can be arranged to be positioned as the wearer wishes, and is comfortable to wear, even if worn all day.

Swivel spring 117 is coiled about a pin (not labelled) whereby the end of the spring can be seen in FIG. 37. Swivel spring 117 acts against pushing from the front to bias the parts of the keeper together unless released. Swivel spring 117 is a coiled metal spring of wire. Other resilient "springs" may be used instead. Or a standard swivel may be used instead, or an alternative clasp.

The illustrated jewellery keeper 101 is made of plated gold but other precious metals, plate metals may be used or alternatively other metals, such a stainless may be used. Part of the advantage to jewellery keeper 101 is that it is jewellery itself, a very attractive item, to display the other jewellery items. Not only can it be made any suitable attractive precious metal, but it can be made of a combination of metals, and include engraving, decoration and gemstones to suit the desires of the particular wearer.

Body 110 and ring cage 112 includes ring cage arms 121 and 122 with swivel spring 117 so that these can be pressed closed, as described further below. Jewellery items, such as a ring set, can be easily placed in ring cage 112, by putting between arm 121 or 122 in the open state, and these arms be brought together and secured in the closed state. Holder 160 is of a generally cylindrical shape with a circular face appearance of front 162, cylindrical centre 164, on which the rings can rest. Cylindrical centre 164 is made of a soft metal than the intended jewellery so that the wear section wears first, and no damage is passed on to the jewellery due to use of the jewellery keeper.

As can be seen in particular in FIG. 39, the rear of keeper 101 can be seen, with rear ring 164, which fits with a press fit within cylindrical centre 162 so that the two arms 121 and 122 can be pressed together to press together the two parts of holder 160 with wear centre 164. These parts of holder 160 are designed to neatly fit together and press and hold due to the bias of swivel spring 117, tightly together, to lock until released. Release can be caused by pressing on swivel spring 117, which press releases the bias pressure to enable holder 160 parts to be separated. In this way the jewellery can be removed, as the lock is opened to enable the two parts of jewellery cage 112 open to separate 121 and 122 arms. Rotation of ring cage arm 121 about holder 160 enables separation to facilitate the opening of jewellery cage 112, so the jewellery items can be readily placed on cylindrical holder 164, with its wear protection material (softer than the jewellery) acting to prevent scratching or damage to the jewellery items. Decoration on cylindrical centre 162 assists to present the jewellery keeper and jewellery items together as an attractive piece of jewellery in its own right.

The invention works particularly well for rings, but can be used for any number of items, anything that can be kept in the ring cage. Other valuable items such as other items one may be held on a key fob can likewise be used held on ring cage 112.

The second preferred form of the embodiment is an easy to use, secure means to present and wear jewellery with a very attractive appearance.

It will be apparent to a person skilled in the art that changes may be made to the embodiment disclosed herein without departing from the spirit and scope of the invention in its various aspects.

REFERENCE SIGNS LIST:

| | | | |
|---|---|---|---|
| 1 | Jewellery keeper | 36 | Catch part of safety catch |
| 2 | Engagement Ring | 38 | Separated wear insert |
| 3 | Ring | 40 | Hook of 38 |
| 4 | Ring | 42 | Hook of 38 |
| 10 | Body of keeper | 44 | Hook of 38 |
| 12 | Ring cage | 46 | Flat wear insert |
| 14 | Secure closure | 48 | Top of 46 |
| 16 | Bale | 50 | Base of 46 |
| 17 | Swivel | 101 | Jewellery Keeper |
| 18 | First part 14 | 110 | Body of keeper |
| 19 | Second part of 14 | 112 | Ring cage |
| 20a, b | Pins for rivets | 116 | Bale |
| 21/22 | Ring cage arm | 117 | Swivel spring |
| 24 | Ring cage hinge | 121/22 | Ring cage arms |
| 26 | Safety catch | 160 | Holder |
| 28 | Holes | 162 | Front of holder |
| 30 | First part of safety catch | 164 | Central Holder |
| 32 | Second part of safety catch | 166 | Rear of holder |
| 34 | Third part of safety catch | | |

The invention claimed is:

1. A jewellery keeper, wearable by a person, for securely holding jewellery items, the jewellery keeper including:

a keeper body including at least two moveable parts rotatably movable between an open state and a closed state, a first arm and a second arm, and a holder adapted to connect the first arm and the second arm such that the first arm and the second arm are rotatable to form a jewellery cage in the closed state, and are able to receive one or more jewellery items in the open state;

the holder comprising a first generally cylindrical body and a second generally cylindrical body, the first generally cylindrical body adapted to mate with the second generally cylindrical body, wherein, the first substantially cylindrical body is attached to the first arm and the second substantially cylindrical body is attached to the second arm and the first generally cylindrical body is positioned within the second substantially cylindrical body;

the second generally cylindrical body having an outer surface that is a generally cylindrical wear centre, the generally cylindrical wear centre adapted to receive the one or more jewellery items thereon when the keeper body is in the open state, and the generally cylindrical wear centre comprising a suitable soft metal material so that contact between the generally cylindrical wear centre and the one or more jewellery items does not damage the one or more jewellery items;

a secure closure comprising a spring, the secure closure locking the keeper body and maintaining the keeper body in a securely closed state so that the one or more jewellery items cannot be released from the jewellery cage of the keeper body without operation of the secure closure and rotation of the first arm and the second arm to place the keeper body in the open state.

2. The jewellery keeper of claim 1, wherein the jewellery keeper is shaped to be a fob.

3. The jewellery keeper of claim 1, wherein the jewellery keeper is a pendent.

4. The jewellery keeper of claim 1, wherein the jewellery keeper includes precious metals.

5. The jewellery keeper of claim 1, wherein the overall shape of the jewellery keeper, when viewed from the front is a teardrop shape.

6. The jewellery keeper of claim 1, wherein the jewellery keeper includes ornamentation, decoration, engraving, or gemstones.

7. The jewellery keeper of claim 1, wherein the one or more jewellery items are held in an upright orientation or a hanging orientation.

* * * * *